US009047859B2

(12) United States Patent
Ravelli et al.

(10) Patent No.: US 9,047,859 B2
(45) Date of Patent: Jun. 2, 2015

(54) APPARATUS AND METHOD FOR ENCODING AND DECODING AN AUDIO SIGNAL USING AN ALIGNED LOOK-AHEAD PORTION

(71) Applicant: Fraunhofer-Gesellschaft zur Foerderung der angewandten Forschung e.V., Munich (DE)

(72) Inventors: Emmanuel Ravelli, Erlangen (DE); Ralf Geiger, Erlangen (DE); Markus Schnell, Nuremberg (DE); Guillaume Fuchs, Erlangen (DE); Vesa Ruoppila, Nuremberg (DE); Tom Baeckstroem, Nuremberg (DE); Bernhard Grill, Lauf (DE); Christian Helmrich, Erlangen (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 13/966,666

(22) Filed: Aug. 14, 2013

(65) Prior Publication Data

US 2013/0332148 A1 Dec. 12, 2013

Related U.S. Application Data

(63) Continuation of application No. PCT/EP2012/052450, filed on Feb. 14, 2012.

(60) Provisional application No. 61/442,632, filed on Feb. 14, 2011.

(51) Int. Cl.

| | |
|---|---|
| ***G10L 19/12*** | (2013.01) |
| ***G10L 19/00*** | (2013.01) |
| ***G10L 19/012*** | (2013.01) |
| ***G10K 11/16*** | (2006.01) |
| ***G10L 19/005*** | (2013.01) |
| ***G10L 19/03*** | (2013.01) |
| ***G10L 19/22*** | (2013.01) |
| *G10L 19/04* | (2013.01) |
| *G10L 19/02* | (2013.01) |
| *G10L 25/06* | (2013.01) |
| *G10L 19/025* | (2013.01) |
| *G10L 19/107* | (2013.01) |

(52) U.S. Cl.

CPC ..... *G10L 19/00* (2013.01); *G10L 19/012* (2013.01); *G10K 11/16* (2013.01); *G10L 19/04* (2013.01); *G10L 19/005* (2013.01); *G10L 19/12* (2013.01); *G10L 19/0212* (2013.01); *G10L 19/03* (2013.01); *G10L 25/06* (2013.01); *G10L 19/025* (2013.01); *G10L 19/107* (2013.01); *G10L 19/22* (2013.01)

(58) Field of Classification Search

CPC ..... G10L 19/012; G10L 19/005; G10L 19/12; G10L 19/22; G10L 19/0212; G10L 25/06; G10L 19/025; G10L 19/07; G10L 19/03

USPC ..... 704/219, 223, 222, 208, 233, 254, 220, 704/225, 217, 221, 207, 205, 203

See application file for complete search history.

(56) References Cited

U.S. PATENT DOCUMENTS

| | | | | |
|---|---|---|---|---|
| 5,537,510 | A | 7/1996 | Kim | |
| 5,606,642 | A | 2/1997 | Stautner et al. | |
| 5,848,391 | A | 12/1998 | Bosi et al. | |
| 5,953,698 | A | 9/1999 | Hayata | |
| 5,960,389 | A | 9/1999 | Jarvinen et al. | |
| 6,070,137 | A | 5/2000 | Bloebaum et al. | |
| 6,134,518 | A * | 10/2000 | Cohen et al. | 704/201 |
| 6,236,960 | B1 | 5/2001 | Peng et al. | |
| 6,317,117 | B1 | 11/2001 | Goff | |
| 6,532,443 | B1 | 3/2003 | Nishiguchi et al. | |
| 6,757,654 | B1 | 6/2004 | Westerlund et al. | |
| 6,879,955 | B2 | 4/2005 | Rao | |
| 7,124,079 | B1 | 10/2006 | Johansson et al. | |
| 7,280,959 | B2 | 10/2007 | Bessette | |
| 7,343,283 | B2 * | 3/2008 | Ashley et al. | 704/219 |
| 7,363,218 | B2 | 4/2008 | Jabri et al. | |
| 7,519,535 | B2 | 4/2009 | Spindola | |
| 7,519,538 | B2 | 4/2009 | Villemoes et al. | |
| 7,536,299 | B2 | 5/2009 | Cheng et al. | |

| | | | | |
|---|---|---|---|---|
| 7,707,034 | B2 | 4/2010 | Sun et al. | |
| 7,873,511 | B2 | 1/2011 | Herre et al. | |
| 7,933,769 | B2 * | 4/2011 | Bessette | 704/219 |
| 7,979,271 | B2 * | 7/2011 | Bessette | 704/219 |
| 7,987,089 | B2 * | 7/2011 | Krishnan et al. | 704/214 |
| 8,121,831 | B2 | 2/2012 | Oh et al. | |
| 8,160,274 | B2 | 4/2012 | Bongiovi | |
| 8,255,207 | B2 | 8/2012 | Vaillancourt et al. | |
| 8,428,936 | B2 * | 4/2013 | Mittal et al. | 704/203 |
| 8,566,106 | B2 | 10/2013 | Salami et al. | |
| 8,630,862 | B2 * | 1/2014 | Geiger et al. | 704/500 |
| 8,630,863 | B2 * | 1/2014 | Son et al. | 704/501 |
| 2002/0111799 | A1 | 8/2002 | Bernard | |
| 2002/0184009 | A1 | 12/2002 | Heikkinen | |
| 2003/0009325 | A1 * | 1/2003 | Kirchherr et al. | 704/211 |
| 2003/0078771 | A1 | 4/2003 | Jung et al. | |
| 2004/0225505 | A1 | 11/2004 | Andersen et al. | |
| 2005/0091044 | A1 | 4/2005 | Ramo et al. | |
| 2005/0130321 | A1 | 6/2005 | Nicholson et al. | |
| 2005/0131696 | A1 | 6/2005 | Wang et al. | |
| 2005/0154584 | A1 | 7/2005 | Jelinek et al. | |
| 2005/0240399 | A1 | 10/2005 | Makinen | |
| 2005/0278171 | A1 | 12/2005 | Suppappola et al. | |
| 2006/0206334 | A1 | 9/2006 | Kapoor et al. | |
| 2006/0271356 | A1 | 11/2006 | Vos | |
| 2006/0293885 | A1 | 12/2006 | Gournay et al. | |
| 2007/0016404 | A1 | 1/2007 | Kim et al. | |
| 2007/0050189 | A1 | 3/2007 | Cruz-Zeno et al. | |
| 2007/0100607 | A1 * | 5/2007 | Villemoes | 704/207 |
| 2007/0147518 | A1 | 6/2007 | Bessette | |
| 2007/0171931 | A1 | 7/2007 | Manjunath et al. | |
| 2007/0225971 | A1 * | 9/2007 | Bessette | 704/203 |
| 2007/0253577 | A1 | 11/2007 | Yen et al. | |
| 2007/0282603 | A1 * | 12/2007 | Bessette | 704/219 |
| 2008/0010064 | A1 * | 1/2008 | Takeuchi et al. | 704/229 |
| 2008/0015852 | A1 | 1/2008 | Kruger et al. | |
| 2008/0027719 | A1 * | 1/2008 | Kirshnan et al. | 704/214 |
| 2008/0052068 | A1 | 2/2008 | Aguilar et al. | |
| 2008/0208599 | A1 | 8/2008 | Rosec et al. | |
| 2008/0275580 | A1 | 11/2008 | Andersen | |
| 2009/0024397 | A1 * | 1/2009 | Ryu et al. | 704/500 |
| 2009/0226016 | A1 | 9/2009 | Fitz et al. | |
| 2010/0017200 | A1 | 1/2010 | Oshikiri et al. | |
| 2010/0063812 | A1 | 3/2010 | Gao | |
| 2010/0070270 | A1 | 3/2010 | Gao | |
| 2010/0138218 | A1 | 6/2010 | Geiger | |
| 2010/0198586 | A1 | 8/2010 | Edler et al. | |
| 2010/0217607 | A1 | 8/2010 | Neuendorf et al. | |
| 2011/0153333 | A1 | 6/2011 | Bessette | |
| 2011/0161088 | A1 | 6/2011 | Bayer et al. | |
| 2011/0178795 | A1 | 7/2011 | Bayer et al. | |
| 2011/0218797 | A1 * | 9/2011 | Mittal et al. | 704/200 |
| 2011/0218799 | A1 * | 9/2011 | Mittal et al. | 704/203 |
| 2011/0311058 | A1 * | 12/2011 | Oh et al. | 381/2 |
| 2012/0022881 | A1 | 1/2012 | Geiger et al. | |
| 2012/0226505 | A1 | 9/2012 | Lin et al. | |

FOREIGN PATENT DOCUMENTS

| | | | |
|---|---|---|---|
| AU | 2007/312667 | | 4/2008 |
| CN | 1274456 | A | 11/2000 |
| CN | 1344067 | A | 4/2002 |
| CN | 1381956 | A | 11/2002 |
| CN | 1437747 | A | 8/2003 |
| CN | 1539137 | A | 10/2004 |
| CN | 1539138 | A | 10/2004 |
| CN | 101351840 | | 10/2006 |
| CN | 101110214 | A | 1/2008 |
| CN | 101366077 | A | 2/2009 |
| CN | 101371295 | A | 2/2009 |
| CN | 101379551 | A | 3/2009 |
| CN | 101388210 | A | 3/2009 |
| CN | 101425292 | A | 5/2009 |
| CN | 101483043 | A | 7/2009 |
| CN | 101488344 | A | 7/2009 |
| CN | 101743587 | | 6/2010 |
| CN | 101770775 | A | 7/2010 |
| EP | 0673566 | A1 | 9/1995 |
| EP | 0758123 | A2 | 2/1997 |
| EP | 0843301 | B1 | 5/1998 |
| EP | 1120775 | A1 | 8/2001 |
| EP | 1852851 | | 7/2007 |
| EP | 2107556 | | 7/2009 |
| JP | 10039898 | A | 2/1998 |
| JP | H10214100 | A | 8/1998 |
| JP | H11502318 | A | 2/1999 |
| JP | H1198090 | A | 4/1999 |
| JP | 2000357000 | A | 12/2000 |
| JP | 2002-118517 | | 4/2002 |
| JP | 2003501925 | A | 1/2003 |
| JP | 2003506764 | A | 2/2003 |
| JP | 2004514182 | A | 5/2004 |
| JP | 2006504123 | A | 2/2006 |
| JP | 2007065636 | A | 3/2007 |
| JP | 2007523388 | A | 8/2007 |
| JP | 2007525707 | A | 9/2007 |
| JP | 2007538282 | A | 12/2007 |
| JP | 2008-15281 | | 1/2008 |
| JP | 2008261904 | A | 10/2008 |
| JP | 2009508146 | A | 2/2009 |
| JP | 2009522588 | A | 6/2009 |
| JP | 2009-527773 | | 7/2009 |
| JP | 2010-538314 | | 12/2010 |
| JP | 2010539528 | A | 12/2010 |
| JP | 2011501511 | A | 1/2011 |
| JP | 2011527444 | A | 10/2011 |
| KR | 10-2004-0043278 | A | 5/2004 |
| RU | 2183034 | C2 | 5/2002 |
| TW | 200830277 | | 10/1996 |
| TW | 200943279 | | 10/1998 |
| TW | 201032218 | | 9/1999 |
| TW | 380246 | B | 1/2000 |
| TW | 469423 | B | 12/2001 |
| TW | I253057 | B | 4/2006 |
| TW | 200703234 | A | 1/2007 |
| TW | 200729156 | A | 8/2007 |
| TW | 200841743 | A | 10/2008 |
| TW | I313856 | B | 8/2009 |
| TW | 200943792 | A | 10/2009 |
| TW | I316225 | B | 10/2009 |
| TW | I 320172 | | 2/2010 |
| TW | 201009810 | A | 3/2010 |
| TW | 201009812 | A | 3/2010 |
| TW | I324762 | B | 5/2010 |
| TW | 201027517 | A | 7/2010 |
| TW | 201030735 | A | 8/2010 |
| TW | 201040943 | | 11/2010 |
| TW | I333643 | B | 11/2010 |
| TW | 201103009 | | 1/2011 |
| WO | 92/22891 | A1 | 12/1992 |
| WO | 95/10890 | A1 | 4/1995 |
| WO | 96/29696 | A1 | 9/1996 |
| WO | 0075919 | A1 | 12/2000 |
| WO | 02/101724 | A1 | 12/2002 |
| WO | 02101724 | A1 | 12/2002 |
| WO | WO-02101722 | | 12/2002 |
| WO | 2004027368 | A1 | 4/2004 |
| WO | 2005078706 | A1 | 8/2005 |
| WO | 2005081231 | A1 | 9/2005 |
| WO | 2005112003 | A1 | 11/2005 |
| WO | 2006126844 | A2 | 11/2006 |
| WO | WO-2007051548 | | 5/2007 |
| WO | 2007083931 | A1 | 7/2007 |
| WO | WO-2007073604 | | 7/2007 |
| WO | WO2007/096552 | | 8/2007 |
| WO | WO-2008013788 | | 10/2008 |
| WO | WO-2009029032 | | 3/2009 |
| WO | 2009077321 | A3 | 10/2009 |
| WO | 2010003491 | A1 | 1/2010 |
| WO | WO-2010/003491 | | 1/2010 |
| WO | WO-2010003532 | | 1/2010 |
| WO | WO-2010040522 | | 4/2010 |
| WO | 2010059374 | A1 | 5/2010 |
| WO | 2010093224 | A2 | 8/2010 |
| WO | 2011/006369 | A1 | 1/2011 |

WO WO-2011048094 4/2011
WO 2011/147950 A1 12/2011

OTHER PUBLICATIONS

A Silence Compression Scheme for G.729 Optimized for Terminals Conforming to Recommendation V.70, ITU-T Recommendation G.729—Annex B, International Telecommunication Union, pp. 1-16., Nov. 1996.
Martin, R., Spectral Subtraction Based on Minimum Statistics, Proceedings of European Signal Processing Conference (EUSIPCO), Edinburg, Scotland, Great Britain, Sep. 1994, pp. 1182-1185.
"Digital Cellular Telecommunications System (Phase 2+); Universal Mobile Telecommunications System (UMTS); LTE; Speech codec speech processing functions; Adaptive Multi-Rate-Wideband (AMR-)WB Speech Codec; Transcoding Functions (3GPP TS 26.190 version 9.0.0", Technical Specification, European Telecommunications Standards Institute (ETSI) 650, Route Des Lucioles; F-06921 Sophia-Antipolis; France; No. V9.0.0, Jan. 1, 2012, 54 Pages.
"IEEE Signal Processing Letters", IEEE Signal Processing Society. vol. 15. ISSN 1070-9908., 2008, 9 Pages.
"Information Technology—MPEG Audio Technologies—Part 3: Unified Speech and Audio Coding", ISO/IEC JTC 1/SC 29 ISO/IEC DIS 23003-3, Feb. 9, 2011, 233 Pages.
"WD7 of USAC", International Organisation for Standardisation Organisation Internationale De Normailisation. ISO/IEC JTC1/SC29/WG11. Coding of Moving Pictures and Audio. Dresden, Germany., Apr. 2010, 148 Pages.
3GPP, , "3rd Generation Partnership Project; Technical Specification Group Service and System Aspects. Audio Codec Processing Functions. Extended AMR Wideband Codec; Transcoding functions (Release 6).", 3GPP Draft; 26.290, V2.0.0 3rd Generation Partnership Project (3GPP), Mobile Competence Centre; Valbonne, France., Sep. 2004, pp. 1-85.
Ashley, J et al., "Wideband Coding of Speech Using a Scalable Pulse Codebook", 2000 IEEE Speech Coding Proceedings., Sep. 17, 2000, pp. 148-150.
Bessette, B et al., "The Adaptive Multirate Wideband Speech Codec (AMR-WB)", IEEE Transactions on Speech and Audio Processing, IEEE Service Center. New York. vol. 10, No. 8., Nov. 1, 2002, pp. 620-636.
Bessette, B et al., "Universal Speech/Audio Coding Using Hybrid ACELP/TCX Techniques", ICASSP 2005 Proceedings. IEEE International Conference on Acoustics, Speech, and Signal Processing, vol. 3,, Jan. 2005, pp. 301-304.
Bessette, B et al., "Wideband Speech and Audio Codec at 16/24/32 Kbit/S Using Hybrid ACELP/TCX Techniques", 1999 IEEE Speech Coding Proceedings. Porvoo, Finland., Jun. 20, 1999, pp. 7-9.
Ferreira, A et al., "Combined Spectral Envelope Normalization and Subtraction of Sinusoidal Components in the ODFTand MDCT Frequency Domains", 2001 IEEE Workshop on Applications of Signal Processing to Audio and Acoustics., Oct. 2001, pp. 51-54.
Fischer, et al., "Enumeration Encoding and Decoding Algorithms for Pyramid Cubic Lattice and Trellis Codes", IEEE Transactions on Information Theory. IEEE Press, USA, vol. 41, No. 6, Part 2., Nov. 1, 1995, pp. 2056-2061.
Hermansky, H et al., "Perceptual linear predictive (PLP) analysis of speech", J. Acoust. Soc. Amer. 87 (4)., Apr. 1990, pp. 1738-1751.
Hofbauer, K et al., "Estimating Frequency and Amplitude of Sinusoids in Harmonic Signals—A Survey and the Use of Shifted Fourier Transforms", Graz: Graz University of Technology; Graz University of Music and Dramatic Arts; Diploma Thesis, Apr. 2004, 111 pages.
Lanciani, C et al., "Subband-Domain Filtering of MPEG Audio Signals", 1999 IEEE International Conference on Acoustics, Speech, and Signal Processing. Phoenix, , AZ, USA., Mar. 15, 1999, pp. 917-920.
Lauber, P et al., "Error Concealment for Compressed Digital Audio", Presented at the 111th AES Convention. Paper 5460. New York, USA., Sep. 21, 2001, 12 Pages.
Lee, Ick Don et al., "A Voice Activity Detection Algorithm for Communication Systems with Dynamically Varying Background Acoustic Noise", Dept. of Electrical Engineering, 1998 IEEE, May 18-21, 1998, pp. 1214-1218.
Makinen, J et al., "AMR-WB+: a New Audio Coding Standard for 3rd Generation Mobile Audio Services", 2005 IEEE International Conference on Acoustics, Speech, and Signal Processing. Philadelphia, PA, USA., Mar. 18, 2005, 1109-1112.
Motlicek, P et al., "Audio Coding Based on Long Temporal Contexts", Rapport de recherche de l'IDIAP 06-30, Apr. 2006, pp. 1-10.
Neuendorf, M et al., "A Novel Scheme for Low Bitrate Unified Speech Audio Coding—MPEG RMO", AES 126th Convention. Convention Paper 7713. Munich, Germany, May 1, 2009, 13 Pages.
Neuendorf, M et al., "Completion of Core Experiment on unification of USAC Windowing and Frame Transitions", International Organisation for Standardisation Organisation Internationale De Normalisation ISOIEC JTC1/SC29/WG11. Coding of Moving Pictures and Audio. Kyoto, Japan., Jan. 2010, 52 Pages.
Neuendorf, M et al., "Unified Speech and Audio Coding Scheme for High Quality at Low Bitrates", ICASSP 2009 IEEE International Conference on Acoustics, Speech and Signal Processing. Piscataway, NJ, USA., Apr. 19, 2009, 4 Pages.
Patwardhan, P et al., "Effect of Voice Quality on Frequency-Warped Modeling of Vowel Spectra", Speech Communication. vol. 48, No. 8., Aug. 2006, pp. 1009-1023.
Ryan, D et al., "Reflected Simplex Codebooks for Limited Feedback MIMO Beamforming", IEEE. XP31506379A., Jun. 14-18, 2009, 6 Pages.
Sjoberg, J et al., "RTP Payload Format for the Extended Adaptive Multi-Rate Wideband (AMR-WB+) Audio Codec", Memo. The Internet Society. Network Working Group. Category: Standards Track., Jan. 2006, pp. 1-38.
Terriberry, T et al., "A Multiply-Free Enumeration of Combinations with Replacement and Sign", IEEE Signal Processing Letters. vol. 15, 2008, 11 Pages.
Terriberry, T et al., "Pulse Vector Coding", Retrieved from the internet on Oct. 12, 2012. XP55025946. URL:http://people.xiph.org/~tterribe/notes/cwrs.html, Dec. 1, 2007, 4 Pages.
Virette, D et al., "Enhanced Pulse Indexing CE for ACELP in USAC", Organisation Internationale De Normalisation ISO/IEC JTC1/SC29/WG11. MPEG2012/M19305. Coding of Moving Pictures and Audio. Daegu, Korea., Jan. 2011, 13 Pages.
Wang, F et al., "Frequency Domain Adaptive Postfiltering for Enhancement of Noisy Speech", Speech Communication 12. Elsevier Science Publishers. Amsterdam, North-Holland. vol. 12, No. 1., Mar. 1993, 41-56.
Waterschoot, T et al., "Comparison of Linear Prediction Models for Audio Signals", EURASIP Journal on Audio, Speech, and Music Processing. vol. 24., Dec. 2008, 27 pages.
Zernicki, T et al., "Report on CE on Improved Tonal Component Coding in eSBR", International Organisation for Standardisation Organisation Internationale De Normalisation ISO/IEC JTC1/SC29/WG11. Coding of Moving Pictures and Audio. Daegu, South Korea, Jan. 2011, 20 Pages.

* cited by examiner

*Primary Examiner* — Vijay B Chawan
(74) *Attorney, Agent, or Firm* — Michael A. Glenn; Perkins Coie LLP

(57) ABSTRACT

An apparatus for encoding an audio signal having a stream of audio samples has: a windower for applying a prediction coding analysis window to the stream of audio samples to obtain windowed data for a prediction analysis and for applying a transform coding analysis window to the stream of audio samples to obtain windowed data for a transform analysis, wherein the transform coding analysis window is associated with audio samples within a current frame of audio samples and with audio samples of a predefined portion of a future frame of audio samples being a transform-coding look-ahead portion, wherein the prediction coding analysis window is associated with at least the portion of the audio samples of the current frame and with audio samples of a predefined portion of the future frame being a prediction coding look-ahead portion, wherein the transform coding look-ahead portion and the prediction coding look-ahead portion are identically to each other or are different from each other by less than 20%; and an encoding processor for generating prediction coded data or for generating transform coded data.

26 Claims, 17 Drawing Sheets

APPARATUS AND METHOD FOR ENCODING AND DECODING AN AUDIO SIGNAL USING AN ALIGNED LOOK-AHEAD PORTION

CROSS-REFERENCE TO RELATED APPLICATIONS

This application is a continuation of copending International Application No. PCT/EP2012/052450, filed Feb. 14, 2012, which is incorporated herein by reference in its entirety, and additionally claims priority from U.S. Provisional Application No. 61/442,632, filed Feb. 14, 2011, which is also incorporated herein by reference in its entirety.

BACKGROUND OF THE INVENTION

The present invention is related to audio coding and, particularly, to audio coding relying on switched audio encoders and correspondingly controlled audio decoders, particularly suitable for low-delay applications.

Several audio coding concepts relying on switched codecs are known. One well-known audio coding concept is the so-called Extended Adaptive Multi-Rate-Wideband (AMR-WB+) codec, as described in 3GPP TS 26.290 B10.0.0 (2011-03). The AMR-WB+ audio codec contains all the AMR-WB speech codec modes 1 to 9 and AMR-WB VAD and DTX. AMR-WB+ extends the AMR-WB codec by adding TCX, bandwidth extension, and stereo.

The AMR-WB+ audio codec processes input frames equal to 2048 samples at an internal sampling frequency $F_s$. The internal sampling frequency is limited to the range of 12800 to 38400 Hz. The 2048 sample frames are split into two critically sampled equal frequency bands. This results in two super-frames of 1024 samples corresponding to the low frequency (LF) and high frequency (HF) bands. Each super-frame is divided into four 256-sample frames. Sampling at the internal sampling rate is obtained by using a variable sampling conversion scheme, which re-samples the input signal.

The LF and HF signals are then encoded using two different approaches: the LF is encoded and decoded using the "core" encoder/decoder based on switched ACELP and transform coded excitation (TCX). In ACELP mode, the standard AMR-WB codec is used. The HF signal is encoded with relatively few bits (16 bits/frame) using a bandwidth extension (BWE) method. The parameters transmitted from encoder to decoder are the mode selection bits, the LF parameters and the HF parameters. The parameters for each 1024 samples super-frame are decomposed into four packets of identical size. When the input signal is stereo, the left and right channels are combined into a mono-signal for ACELP/TCX encoding, whereas the stereo encoding receives both input channels. On the decoder-side, the LF and HF bands are decoded separately after which they are combined in a synthesis filterbank. If the output is restricted to mono only, the stereo parameters are omitted and the decoder operates in mono mode. The AMR-WB+ codec applies LP analysis for both the ACELP and TCX modes when encoding the LF signal. The LP coefficients are interpolated linearly at every 64-samples subframe. The LP analysis window is a half-cosine of length 384 samples. To encode the core mono-signal, either an ACELP or TCX coding is used for each frame. The coding mode is selected based on a closed-loop analysis-by-synthesis method. Only 256-sample frames are considered for ACELP frames, whereas frames of 256, 512 or 1024 samples are possible in TCX mode. The window used for LPC analysis in AMR-WB+ is illustrated in FIG. 5*b*. A symmetric LPC analysis window with look-ahead of 20 ms is used. Look-ahead means that, as illustrated in FIG. 5*b*, the LPC analysis window for the current frame illustrated at 500 not only extends within the current frame indicated between 0 and 20 ms in FIG. 5*b* illustrated by 502, but extends into the future frame between 20 and 40 ms. This means that, by using this LPC analysis window, an additional delay of 20 ms, i.e., a whole future frame is necessitated. Therefore, the look-ahead portion indicated at 504 in FIG. 5*b* contributes to the systematic delay associated with the AMR-WB+ encoder. In other words, a future frame must be fully available so that the LPC analysis coefficients for the current frame 502 can be calculated.

FIG. 5*a* illustrates a further encoder, the so-called AMR-WB coder and, particularly, the LPC analysis window used for calculating the analysis coefficients for the current frame. Once again, the current frame extends between 0 and 20 ms and the future frame extends between 20 and 40 ms. In contrast to FIG. 5*b*, the LPC analysis window of AMR-WB indicated at 506 has a look-ahead portion 508 of 5 ms only, i.e., the time distance between 20 ms and 25 ms. Hence, the delay introduced by the LPC analysis is reduced substantially with respect to FIG. 5*a*. On the other hand, however, it has been found that a larger look-ahead portion for determining the LPC coefficients, i.e., a larger look-ahead portion for the LPC analysis window results in better LPC coefficients and, therefore, a smaller energy in the residual signal and, therefore, a lower bitrate, since the LPC prediction better fits the original signal.

While FIGS. 5*a* and 5*b* relate to encoders having only a single analysis window for determining the LPC coefficients for one frame, FIG. 5*c* illustrates the situation for the G.718 speech coder. The G718 (06-2008) specification is related to transmission systems and media digital systems and networks and, particularly, describes digital terminal equipment and, particularly, a coding of voice and audio signals for such equipment. Particularly, this standard is related to robust narrow-band and wideband embedded variable bitrate coding of speech and audio from 8-32 kbit/s as defined in recommendation ITU-T G718. The input signal is processed using 20 ms frames. The codec delay depends on the sampling rate of input and output. For a wideband input and wideband output, the overall algorithmic delay of this coding is 42.875 ms. It consists of one 20-ms frame, 1.875 ms delay of input and output re-sampling filters, 10 ms for the encoder look-ahead, one ms of post-filtering delay and 10 ms at the decoder to allow for the overlap-add operation of higher layer transform coding. For a narrow band input and a narrow band output, higher layers are not used, but the 10 ms decoder delay is used to improve the coding performance in the presence of frame erasures and for music signals. If the output is limited to layer 2, the codec delay can be reduced by 10 ms. The description of the encoder is as follows. The lower two layers are applied to a pre-emphasized signal sampled at 12.8 kHz, and the upper three layers operate in the input signal domain sampled at 16 kHz. The core layer is based on the code-excited linear prediction (CELP) technology, where the speech signal is modeled by an excitation signal passed through a linear prediction (LP) synthesis filter representing the spectral envelope. The LP filter is quantized in the immittance spectral frequency (ISF) domain using a switched-predictive approach and the multi-stage vector quantization. The open-loop pitch analysis is performed by a pitch-tracking algorithm to ensure a smooth pitch contour. Two concurrent pitch evolution contours are compared and the track that yields the smoother contour is selected in order to make the pitch estimation more robust. The frame level pre-processing comprises a high-pass filtering, a sampling conversion to 12800 samples per second, a pre-emphasis, a spectral analysis, a detection of narrow-band inputs, a voice activity detection, a noise estimation, noise reduction, linear prediction analysis, an LP to ISF conversion, and an interpolation, a computation of a weighted speech signal, an open-loop pitch analysis, a background noise update, a signal classification for a coding mode selection and frame erasure concealment. The layer 1 encoding using the selected encoding type comprises an unvoiced coding mode, a voiced coding mode, a transition coding mode, a generic coding mode, and a discontinuous transmission and comfort noise generation (DTX/CNG).

A long-term prediction or linear prediction (LP) analysis using the auto-correlation approach determines the coefficients of the synthesis filter of the CELP model. In CELP, however, the long-term prediction is usually the "adaptive-codebook" and so is different from the linear-prediction. The linear-prediction can, therefore, be regarded more a short-term prediction. The auto-correlation of windowed speech is converted to the LP coefficients using the Levinson-Durbin algorithm. Then, the LPC coefficients are transformed to the immitance spectral pairs (ISP) and consequently to immitance spectral frequencies (ISF) for quantization and interpolation purposes. The interpolated quantized and unquantized coefficients are converted back to the LP domain to construct synthesis and weighting filters for each subframe. In case of encoding of an active signal frame, two sets of LP coefficients are estimated in each frame using the two LPC analysis windows indicated at 510 and 512 in FIG. 5*c*. Window 512 is called the "mid-frame LPC window", and window 510 is called the "end-frame LPC window". A look-ahead portion 514 of 10 ms is used for the frame-end auto-correlation calculation. The frame structure is illustrated in FIG. 5*c*. The frame is divided into four subframes, each subframe having a length of 5 ms corresponding to 64 samples at a sampling rate of 12.8 kHz. The windows for frame-end analysis and for mid-frame analysis are centered at the fourth subframe and the second subframe, respectively as illustrated in FIG. 5*c*. A Hamming window with the length of 320 samples is used for windowing. The coefficients are defined in G.718, Section 6.4.1. The auto-correlation computation is described in Section 6.4.2. The Levinson-Durbin algorithm is described in Section 6.4.3, the LP to ISP conversion is described in Section 6.4.4, and the ISP to LP conversion is described in Section 6.4.5.

The speech encoding parameters such as adaptive codebook delay and gain, algebraic codebook index and gain are searched by minimizing the error between the input signal and the synthesized signal in the perceptually weighted domain. Perceptually weighting is performed by filtering the signal through a perceptual weighting filter derived from the LP filter coefficients. The perceptually weighted signal is also used in open-loop pitch analysis.

The G.718 encoder is a pure speech coder only having the single speech coding mode. Therefore, the G.718 encoder is not a switched encoder and, therefore, this encoder is disadvantageous in that it only provides a single speech coding mode within the core layer. Hence, quality problems will occur when this coder is applied to other signals than speech signals, i.e., to general audio signals, for which the model behind CELP encoding is not appropriate.

An additional switched codec is the so-called USAC codec, i.e., the unified speech and audio codec as defined in ISO/IEC CD 23003-3 dated Sep. 24, 2010. The LPC analysis window used for this switched codec is indicated in FIG. 5*d* at 516. Again, a current frame extending between 0 and 20 ms is assumed and, therefore, it appears that the look-ahead portion 618 of this codec is 20 ms, i.e., is significantly higher than the look-ahead portion of G.718. Hence, although the USAC encoder provides a good audio quality due to its switched nature, the delay is considerable due to the LPC analysis window look-ahead portion 518 in FIG. 5*d*. The general structure of USAC is as follows. First, there is a common pre/postprocessing consisting of an MPEG surround (MPEGS) functional unit to handle stereo or multi-channel processing and an enhanced SBR (eSBR) unit which handles the parametric representation of the higher audio frequency in the input signal. Then, there are two branches, one consisting of a modified advanced audio coding (AAC) tool path and the other consisting of a linear prediction coding (LP or LPC domain) based path, which in turn features either a frequency domain representation or a time-domain representation of the LPC residual. All transmitted spectra for both, AAC and LPC, are represented in MDCT domain following quantization and arithmetic coding. The time-domain representation uses an ACELP excitation coding scheme. The ACELP tool provides a way to efficiently represent a time domain excitation signal by combining a long-term predictor (adaptive codeword) with a pulse-like sequence (innovation codeword). The reconstructed excitation is sent through an LP synthesis filter to form a time domain signal. The input to the ACELP tool comprises adaptive and innovation codebook indices, adaptive and innovation codes gain values, other control data and inversely quantized and interpolated LPC filter coefficients. The output of the ACELP tool is the time-domain reconstructed audio signal.

The MDCT-based TCX decoding tool is used to turn the weighted LP residual representation from an MDCT domain back into a time domain signal and outputs the weighted time-domain signal including weighted LP synthesis filtering. The IMDCT can be configured to support 256, 512 or 1024 spectral coefficients. The input to the TCX tool comprises the (inversely quantized) MDCT spectra, and inversely quantized and interpolated LPC filter coefficients. The output of the TCX tool is the time-domain reconstructed audio signal.

FIG. 6 illustrates a situation in USAC, where the LPC analysis windows 516 for the current frame and 520 for the past or last frame are drawn, and where, in addition, a TCX window 522 is illustrated. The TCX window 522 is centered at the center of the current frame extending between 0 and 20 ms and extends 10 ms into the past frame and 10 ms into the future frame extending between 20 and 40 ms. Hence, the LPC analysis window 516 necessitates an LPC look-ahead portion between 20 and 40 ms, i.e., 20 ms, while the TCX analysis window additionally has a look-ahead portion extending between 20 and 30 ms into the future frame. This means that the delay introduced by the USAC analysis window 516 is 20 ms, while the delay introduced into the encoder by the TCX window is 10 ms. Hence. It becomes clear that the look-ahead portions of both kinds of windows are not aligned to each other. Therefore, even though the TCX window 522 only introduces a delay of 10 ms, the whole delay of the encoder is nevertheless 20 ms due to the LPC analysis window 516. Therefore, even though there is a quite small look-ahead portion for the TCX window, this does not reduce the overall algorithmic delay of the encoder, since the total delay is determined by the highest contribution, i.e., is equal to 20 ms due to the LPC analysis window 516 extending 20 ms into the future frame, i.e., not only covering the current frame but additionally covering the future frame.

It is an object of the present invention to provide an improved coding concept for audio coding or decoding which, on the one hand, provides a good audio quality and which, on the other hand, results in a reduced delay.

SUMMARY

According to an embodiment, an apparatus for encoding an audio signal having a stream of audio samples may have: a windower for applying a prediction coding analysis window to the stream of audio samples to obtain windowed data for a prediction analysis and for applying a transform coding analysis window to the stream of audio samples to obtain windowed data for a transform analysis, wherein the transform coding analysis window is associated with audio samples within a current frame of audio samples and with audio samples of a predefined portion of a future frame of audio samples being a transform-coding look-ahead portion, wherein the prediction coding analysis window is associated with at least the portion of the audio samples of the current frame and with audio samples of a predefined portion of the future frame being a prediction coding look-ahead portion, wherein the transform coding look-ahead portion and the prediction coding look-ahead portion are identical to each other or are different from each other by less than 20% of the prediction coding look-ahead portion or less than 20% of the transform coding look-ahead portion; and an encoding processor for generating prediction coded data for the current frame using the windowed data for the prediction analysis or for generating transform coded data for the current frame using the windowed data for the transform analysis.

According to another embodiment, a method of encoding an audio signal having a stream of audio samples may have the steps of: applying a prediction coding analysis window to the stream of audio samples to obtain windowed data for a prediction analysis and applying a transform coding analysis window to the stream of audio samples to obtain windowed data for a transform analysis, wherein the transform coding analysis window is associated with audio samples within a current frame of audio samples and with audio samples of a predefined portion of a future frame of audio samples being a transform-coding look-ahead portion, wherein the prediction coding analysis window is associated with at least the portion of the audio samples of the current frame and with audio samples of a predefined portion of the future frame being a prediction coding look-ahead portion, wherein the transform coding look-ahead portion and the prediction coding look-ahead portion are identical to each other or are different from each other by less than 20% of the prediction coding look-ahead portion or less than 20% of the transform coding look-ahead portion; and generating prediction coded data for the current frame using the windowed data for the prediction analysis or for generating transform coded data for the current frame using the windowed data for the transform analysis.

According to still another embodiment, an audio decoder for decoding an encoded audio signal may have: a prediction parameter decoder for performing a decoding of data for a prediction coded frame from the encoded audio signal; a transform parameter decoder for performing a decoding of data for a transform coded frame from the encoded audio signal, wherein the transform parameter decoder is configured for performing a spectral-time transform and for applying a synthesis window to transformed data to obtain data for the current frame and a future frame, the synthesis window having a first overlap portion, an adjacent second non-overlapping portion and an adjacent third overlap portion, the third overlap portion being associated with audio samples for the future frame and the non-overlap portion being associated with data of the current frame; and an overlap-adder for overlapping and adding synthesis windowed samples associated with the third overlap portion of a synthesis window for the current frame and synthesis windowed samples associated with the first overlap portion of a synthesis window for the future frame to obtain a first portion of audio samples for the future frame, wherein a rest of the audio samples for the future frame are synthesis windowed samples associated with the second non-overlapping portion of the synthesis window for the future frame obtained without overlap-adding, when the current frame and the future frame have transform-coded data.

According to another embodiment, a method of decoding an encoded audio signal may have the steps of: performing a decoding of data for a prediction coded frame from the encoded audio signal; performing a decoding of data for a transform coded frame from the encoded audio signal, wherein the step of performing a decoding of data for a transform coded frame has performing a spectral-time transform and applying a synthesis window to transformed data to obtain data for the current frame and a future frame, the synthesis window having a first overlap portion, an adjacent second non-overlapping portion and an adjacent third overlap portion, the third overlap portion being associated with audio samples for the future frame and the non-overlap portion being associated with data of the current frame; and overlapping and adding synthesis windowed samples associated with the third overlap portion of a synthesis window for the current frame and synthesis windowed samples associated with the first overlap portion of a synthesis window for the future frame to obtain a first portion of audio samples for the future frame, wherein a rest of the audio samples for the future frame are synthesis windowed samples associated with the second non-overlapping portion of the synthesis window for the future frame obtained without overlap-adding, when the current frame and the future frame have transform-coded data.

Another embodiment may have a computer program having a program code for performing, when running on a computer, the method of encoding an audio signal or the method of decoding an audio signal as mentioned above.

In accordance with the present invention, a switched audio codec scheme is applied having a transform coding branch and a prediction coding branch. Importantly, the two kinds of windows, i.e., the prediction coding analysis window on the one hand and the transform coding analysis window on the other hand are aligned with respect to their look-ahead portion so that the transform coding look-ahead portion and the prediction coding look-ahead portion are identical or are different from each other by less than 20% of the prediction coding look-ahead portion or less than 20% of the transform coding look-ahead portion. It is to be noted that the prediction analysis window" is used not only in the prediction coding branch, but it is actually used in both branches. The LPC analysis is also used for shaping the noise in the transform domain. Therefore, in other words, the look-ahead portions are identical or are quite close to each other. This ensures that an optimum compromise is achieved and that no audio quality or delay features are set into a sub-optimum way. Hence, for the prediction coding in the analysis window it has been found out that the LPC analysis is the better the higher the look-ahead is, but, on the other hand, the delay increases with a higher look-ahead portion. On the other hand, the same is true for the TCX window. The higher the look-ahead portion of the TCX window is, the better the TCX bitrate can be reduced, since longer TCX windows result in lower bitrates in general. Therefore, in accordance with the present invention, the look-ahead portions are identical or quite close to each other and, particularly, less than 20% different from each other. Therefore, the look-ahead portion, which is not desired due to delay reasons is, on the other hand, optimally used by both, encoding/decoding branches.

In view of that, the present invention provides an improved coding concept with, on the one hand, a low-delay when the look-ahead portion for both analysis windows is set low and provides, on the other hand, an encoding/decoding concept with good characteristics due to the fact that the delay which has to be introduced for audio quality reasons or bitrate reasons anyways is optimally used by both coding branches and not only by a single coding branch.

An apparatus for encoding an audio signal having a stream of audio samples comprises a windower for applying a prediction coding analysis window to a stream of audio samples to obtain windowed data for a prediction analysis and for applying a transform coding analysis window to the stream of audio samples to obtain windowed data for a transform analysis. The transform coding analysis window is associated with audio samples of a current frame of audio samples of a predefined look-ahead portion of a future frame of audio samples being a transform coding look-ahead portion.

Furthermore, the prediction coding analysis window is associated with at least a portion of the audio samples of the current frame and with audio samples of a predefined portion of the future frame being a prediction coding look-ahead portion.

The transform coding look-ahead portion and the prediction coding look-ahead portion are identical to each other or are different from each other by less than 20% of the prediction coding look-ahead portion or less than 20% of the transform coding look-ahead portion and are therefore quite close to each other. The apparatus additionally comprises an encoding processor for generating prediction coded data for the current frame using the windowed data for the prediction analysis or for generating transform coded data for the current frame using the window data for transform analysis.

An audio decoder for decoding an encoded audio signal comprises a prediction parameter decoder for performing a decoding of data for a prediction coded frame from the encoded audio signal and, for the second branch, a transform parameter decoder for performing a decoding of data for a transform coded frame from the encoded audio signal.

The transform parameter decoder is configured for performing a spectral-time transform which may be an aliasing-affected transform such as an MDCT or MDST or any other such transform, and for applying a synthesis window to transformed data to obtain a data for the current frame and the future frame. The synthesis window applied by the audio decoder is so that it has a first overlap portion, an adjacent second non-overlap portion and an adjacent third overlap portion, wherein the third overlap portion is associated with audio samples for the future frame and the non-overlap portion is associated with data of the current frame. Additionally, in order to have a good audio quality on the decoder side, an overlap-adder is applied for overlapping and adding synthesis windowed samples associated with the third overlap portion of a synthesis window for the current frame and synthesis windowed samples associated with the first overlap portion of a synthesis window for the future frame to obtain a first portion of audio samples for the future frame, wherein a rest of the audio samples for the future frame are synthesis windowed samples associated with the second non-overlapping portion of the synthesis window for the future frame obtained without overlap-adding, when the current frame and the future frame comprise transform coded data.

Embodiments of the present invention have the feature that the same look-ahead for the transform coding branch such as the TCX branch and the prediction coding branch such as the ACELP branch are identical to each other so that both coding modes have the maximum available look-ahead under delay constraints. Furthermore, it is of advantage that the TCX window overlap is restricted to the look-ahead portion so that a switching from the transform coding mode to the prediction coding mode from one frame to the next frame is easily possible without any aliasing addressing issues.

A further reason to restrict the overlap to the look ahead is for not introducing a delay at the decoder side. If one would have a TCX window with 10 ms look ahead, and e.g. 20 ms overlap, one would introduce 10 ms more delay in the decoder. When one has a TCX window with 10 ms look ahead and 10 ms overlap, one does not have any additional delay at the decoder side. The easier switching is a good consequence of that.

Therefore, it is of advantage that the second non-overlap portion of the analysis window and of course the synthesis window extend until the end of current frame and the third overlap portion only starts with respect to the future frame. Furthermore, the non-zero portion of the TCX or transform coding analysis/synthesis window is aligned with the beginning of the frame so that, again, an easy and low efficiency switching over from one mode to the other mode is available.

Furthermore, it is of advantage that a whole frame consisting of a plurality of subframes, such as four subframes, can either be fully coded in the transform coding mode (such as TCX mode) or fully coded in the prediction coding mode (such as the ACELP mode).

Furthermore, it is of advantage to not only use a single LPC analysis window but two different LPC analysis windows, where one LPC analysis window is aligned with the center of the fourth subframe and is an end frame analysis window while the other analysis window is aligned with the center of the second subframe and is a mid frame analysis window. If the encoder is switched to transform coding, then however it is of advantage to only transmit a single LPC coefficient data set only derived from the LPC analysis based on the end frame LPC analysis window. Furthermore, on the decoder-side, it is of advantage to not use this LPC data directly for transform coding synthesis, and particularly a spectral weighting of TCX coefficients. Instead, it is of advantage to interpolate the TCX data obtained from the end frame LPC analysis window of the current frame with the data obtained by the end frame LPC analysis window from the past frame, i.e. the frame immediately preceding in time the current frame. By transmitting only a single set of LPC coefficients for a whole frame in the TCX mode, a further bitrate reduction can be obtained compared to transmitting two LPC coefficient data sets for mid frame analysis and end frame analysis. When, however, the encoder is switched to ACELP mode, then both sets of LPC coefficients are transmitted from the encoder to the decoder.

Furthermore, it is of advantage that the mid-frame LPC analysis window ends immediately at the later frame border of the current frame and additionally extends into the past frame. This does not introduce any delay, since the past frame is already available and can be used without any delay.

On the other hand, it is of advantage that the end frame analysis window starts somewhere within the current frame and not at the beginning of the current frame. This, however, is not problematic, since, for the forming TCX weighting, an average of the end frame LPC data set for the past frame and the end frame LPC data set for the current frame is used so that, in the end, all data are in a sense used for calculating the LPC coefficients. Hence, the start of the end frame analysis window may be within the look-ahead portion of the end frame analysis window of the past frame.

On the decoder-side, a significantly reduced overhead for switching from one mode to the other mode is obtained. The reason is that the non-overlapping portion of the synthesis window, which may be symmetric within itself, is not associated to samples of the current frame but is associated with samples of a future frame, and therefore only extends within the look-ahead portion, i.e., in the future frame only. Hence, the synthesis window is so that only the first overlap portion advantageously starting at the immediate start of the current frame is within the current frame and the second non-overlapping portion extends from the end of the first overlapping portion to the end of the current frame and, therefore, the second overlap portion coincides with the look-ahead portion. Therefore, when there is a transition from TCX to ACELP, the data obtained due to the overlap portion of the synthesis window is simply discarded and is replaced by prediction coding data which is available from the very beginning of the future frame out of the ACELP branch.

On the other hand, when there is a switch from ACELP to TCX, a specific transition window is applied which immediately starts at the beginning of the current frame, i.e., the frame immediately after the switchover, with a non-overlapping portion so that any data do not have to be reconstructed in order to find overlap "partners". Instead, the non-overlap portion of the synthesis window provides correct data without any overlapping and without any overlap-add procedures necessitated in the decoder. Only for the overlap portions, i.e., the third portion of the window for the current frame and the first portion of the window for the next frame, an overlap-add procedure is useful and performed in order to have, as in a straightforward MDCT, a continuous fade-in/fade-out from one block to the other in order to finally obtain a good audio quality without having to increase the bitrate due to the critically sampled nature of the MDCT as also known in the art under the term "time-domain aliasing cancellation (TDAC).

Furthermore, the decoder is useful in that, for an ACELP coding mode, LPC data derived from the mid-frame window and the end-frame window in the encoder is transmitted while, for the TCX coding mode, only a single LPC data set derived from the end-frame window is used. For spectrally weighting TCX decoded data, however, the transmitted LPC data is not used as it is, but the data is averaged with the corresponding data from the end-frame LPC analysis window obtained for the past frame.

BRIEF DESCRIPTION OF THE DRAWINGS

Embodiments of the present invention are subsequently described with respect to the accompanying drawings, in which.

DETAILED DESCRIPTION OF THE INVENTION

Figure 1A:
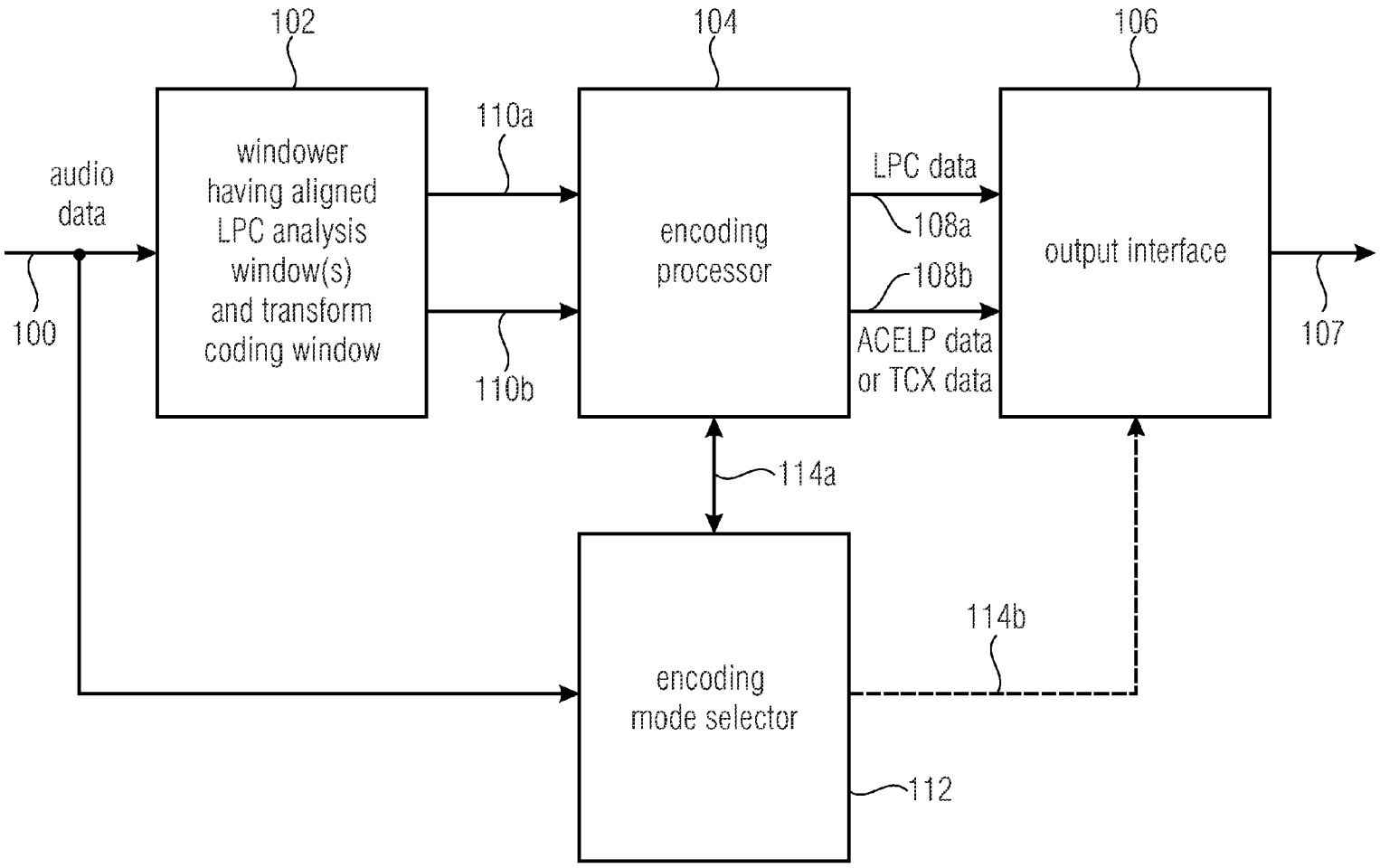
FIG. 1*a* illustrates a block diagram of a switched audio encoder.

FIG. 1 a illustrates an apparatus for encoding an audio signal having a stream of audio samples. The audio samples or audio data enter the encoder at 100. The audio data is introduced into a windower 102 for applying a prediction coding analysis window to the stream of audio samples to obtain windowed data for a prediction analysis. The windower 102 is additionally configured for applying a transform coding analysis window to the stream of audio samples to obtain windowed data for a transform analysis. Depending on the implementation, the LPC window is not applied directly on the original signal but on a "pre-emphasized" signal (like in AMR-WB, AMR-WB+, G718 and USAC). On the other hand the TCX window is applied on the original signal directly (like in USAC). However, both windows can also be applied to the same signals or the TCX window can also be applied to a processed audio signal derived from the original signal such as by pre-emphasizing or any other weighting used for enhancing the quality or compression efficiency.

The transform coding analysis window is associated with audio samples in a current frame of audio samples and with audio samples of a predefined portion of the future frame of audio samples being a transform coding look-ahead portion.

Furthermore, the prediction coding analysis window is associated with at least a portion of the audio samples of the current frame and with audio samples of a predefined portion of the future frame being a prediction coding look-ahead portion.

As outlined in block 102, the transform coding look-ahead portion and the prediction coding look-ahead portion are aligned with each other, which means that these portions are either identical or quite close to each other, such as different from each other by less than 20% of the prediction coding look-ahead portion or less than 20% of the transform coding look-ahead portion. Advantageously, the look-ahead portions are identical or different from each other by less than even 5% of the prediction coding look-ahead portion or less than 5% of the transform coding look-ahead portion.

The encoder additionally comprises an encoding processor 104 for generating prediction coded data for the current frame using the windowed data for the prediction analysis or for generating transform coded data for the current frame using the windowed data for the transform analysis.

Furthermore, the encoder may comprise an output interface 106 for receiving, for a current frame and, in fact, for each frame, LPC data 108*a* and transform coded data (such as TCX data) or prediction coded data (ACELP data) over line 108*b*. The encoding processor 104 provides these two kinds of data and receives, as input, windowed data for a prediction analysis indicated at 110*a* and windowed data for a transform analysis indicated at 110*b*. Furthermore, the apparatus for encoding comprises an encoding mode selector or controller 112 which receives, as an input, the audio data 100 and which provides, as an output, control data to the encoding processor 104 via control lines 114*a*, or control data to the output interface 106 via control line 114*b*.

Figure 3A:
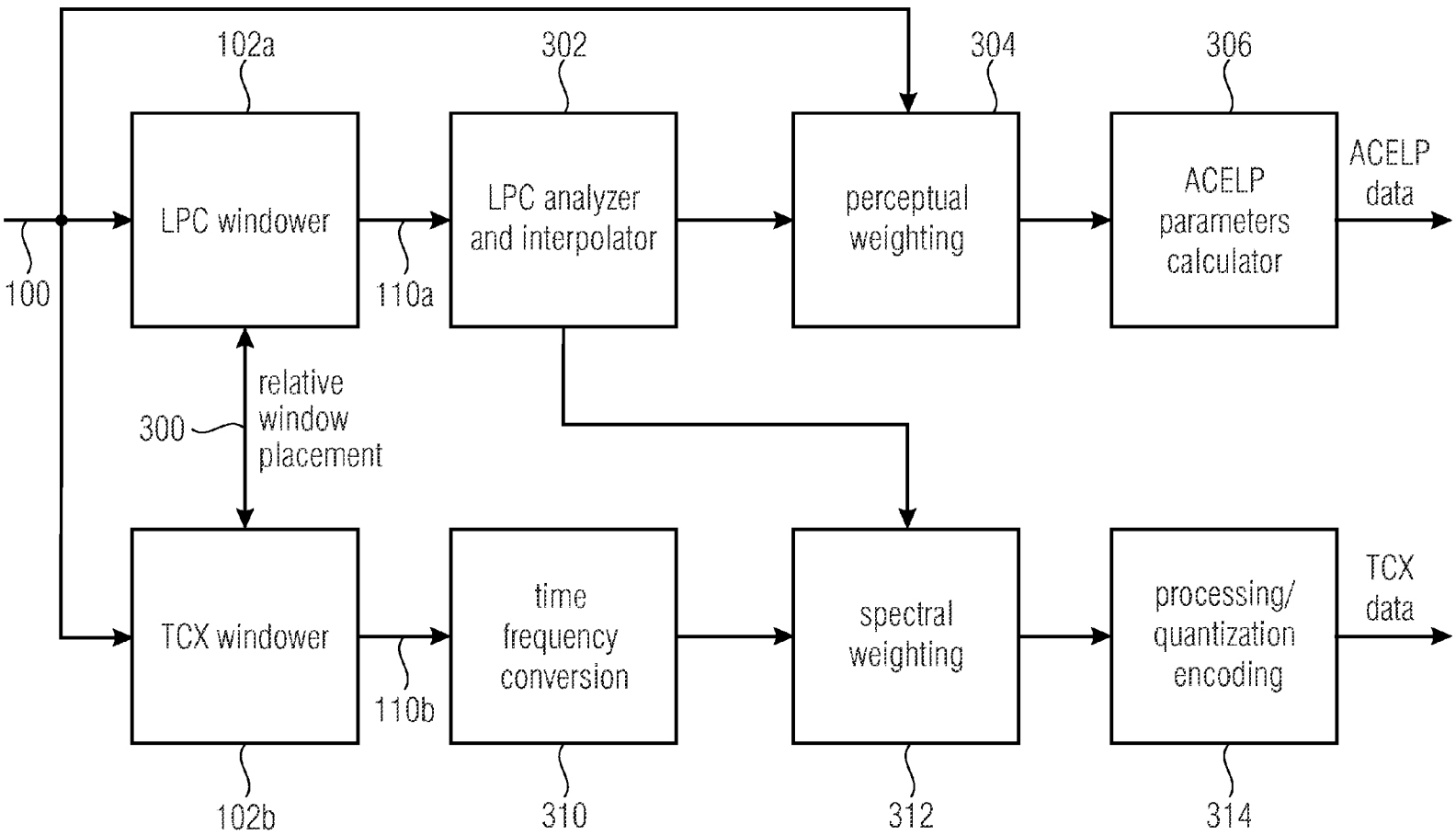
FIG. 3*a* illustrates more details of the encoder of FIG. 1*a;*

FIG. 3*a* provides additional details on the encoding processor 104 and the windower 102. The windower 102 may comprise, as a first module, the LPC or prediction coding analysis windower 102*a* and, as a second component or module, the transform coding windower (such as TCX windower) 102*b*. As indicated by arrow 300, the LPC analysis window and the TCX window are aligned with each other so that the look-ahead portions of both windows are identical to each other, which means that both look-ahead portions extend until the same time instant into a future frame. The upper branch in FIG. 3*a* from the LPC windower 102*a* onwards to the right is a prediction coding branch comprising an LPC analyzer and interpolator 302, a perceptual weighting filter or a weighting block 304 and a prediction coding parameter calculator 306 such as an ACELP parameter calculator. The audio data 100 is provided to the LPC windower 102*a* and the perceptual weighting block 304. Additionally, the audio data is provided to the TCX windower, and the lower branch from the output of the TCX windower to the right constitutes a transform coding branch. This transform coding branch comprises a time-frequency conversion block 310, a spectral weighting block 312 and a processing/quantization encoding block 314. The time frequency conversion block 310 may be implemented as an aliasing—introducing transform such as an MDCT, an MDST or any other transform which has a number of input values being greater than the number of output values. The time-frequency conversion has, as an input, the windowed data output by the TCX or, generally stated, transform coding windower 102*b*.

Although, FIG. 3*a* indicates, for the prediction coding branch, an LPC processing with an ACELP encoding algorithm, other prediction coders such as CELP or any other time domain coders known in the art can be applied as well, although the ACELP algorithm is of advantage due to its quality on the one hand and its efficiency on the other hand.

Furthermore, for the transform coding branch, an MDCT processing particularly in the time-frequency conversion block 310 is of advantage, although any other spectral domain transforms can be performed as well.

Furthermore, FIG. 3*a* illustrates a spectral weighting 312 for transforming the spectral values output by block 310 into an LPC domain. This spectral weighting 312 is performed with weighting data derived from the LPC analysis data generated by block 302 in the prediction coding branch. Alternatively, however, the transform from the time-domain into the LPC domain could also be performed in the time-domain. In this case, an LPC analysis filter would be placed before the TCX windower 102*b* in order to calculate the prediction residual time domain data. However, it has been found that the transform from the time-domain into the LPC-domain may be performed in the spectral domain by spectrally weighting the transform-coded data using LPC analysis data transformed from LPC data into corresponding weighing factors in the spectral domain such as the MDCT domain.

Figure 3B:
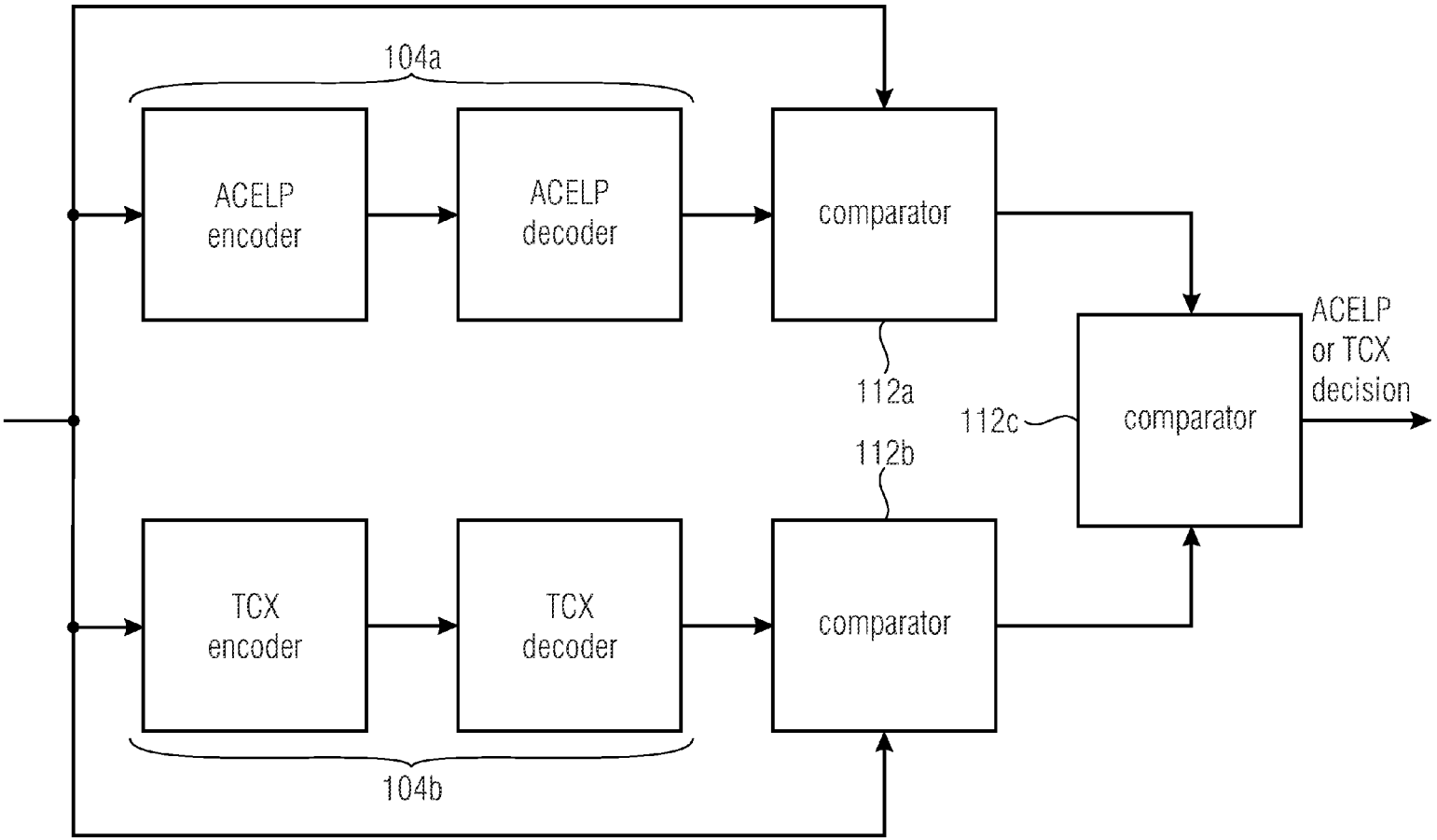
FIG. 3*b* illustrates an analysis-by-synthesis procedure for deciding on a coding mode for a frame.

FIG. 3*b* illustrates the general overview for illustrating an analysis-by-synthesis or "closed-loop" determination of the coding mode for each frame. To this end, the encoder illustrated in FIG. 3*c* comprises a complete transform coding encoder and transform coding decoder as is illustrated at 104*b* and, additionally, comprises a complete prediction coding encoder and corresponding decoder indicated at 104*a* in FIG. 3*c*. Both blocks 104*a*, 104*b* receive, as an input, the audio data and perform a full encoding/decoding operation. Then, the results of the encoding/decoding operation for both coding branches 104*a*, 104*b* are compared to the original signal and a quality measure is determined in order to find out which coding mode resulted in a better quality. The quality measure can be a segmented SNR value or an average segmental SNR such as, for example, described in Section 5.2.3 of 3GPP TS 26.290. However, any other quality measures can be applied as well which typically rely on a comparison of the encoding/decoding result with the original signal.

Based on the quality measure which is provided from each branch 104*a*, 104*b* to the decider 112, the decider decides whether the current examined frame is to be encoded using ACELP or TCX. Subsequent to the decision, there are several ways in order to perform the coding mode selection. One way is that the decider 112 controls the corresponding encoder/decoder blocks 104*a*, 104*b*, in order to simply output the coding result for the current frame to the output interface 106, so that it is made sure that, for a certain frame, only a single coding result is transmitted in the output coded signal at 107.

Alternatively, both devices 104*a*, 104*b* could forward their encoding result already to the output interface 106, and both results are stored in the output interface 106 until the decider controls the output interface via line 105 to either output the result from block 104*b* or from block 104*a*.

Figure 3C:
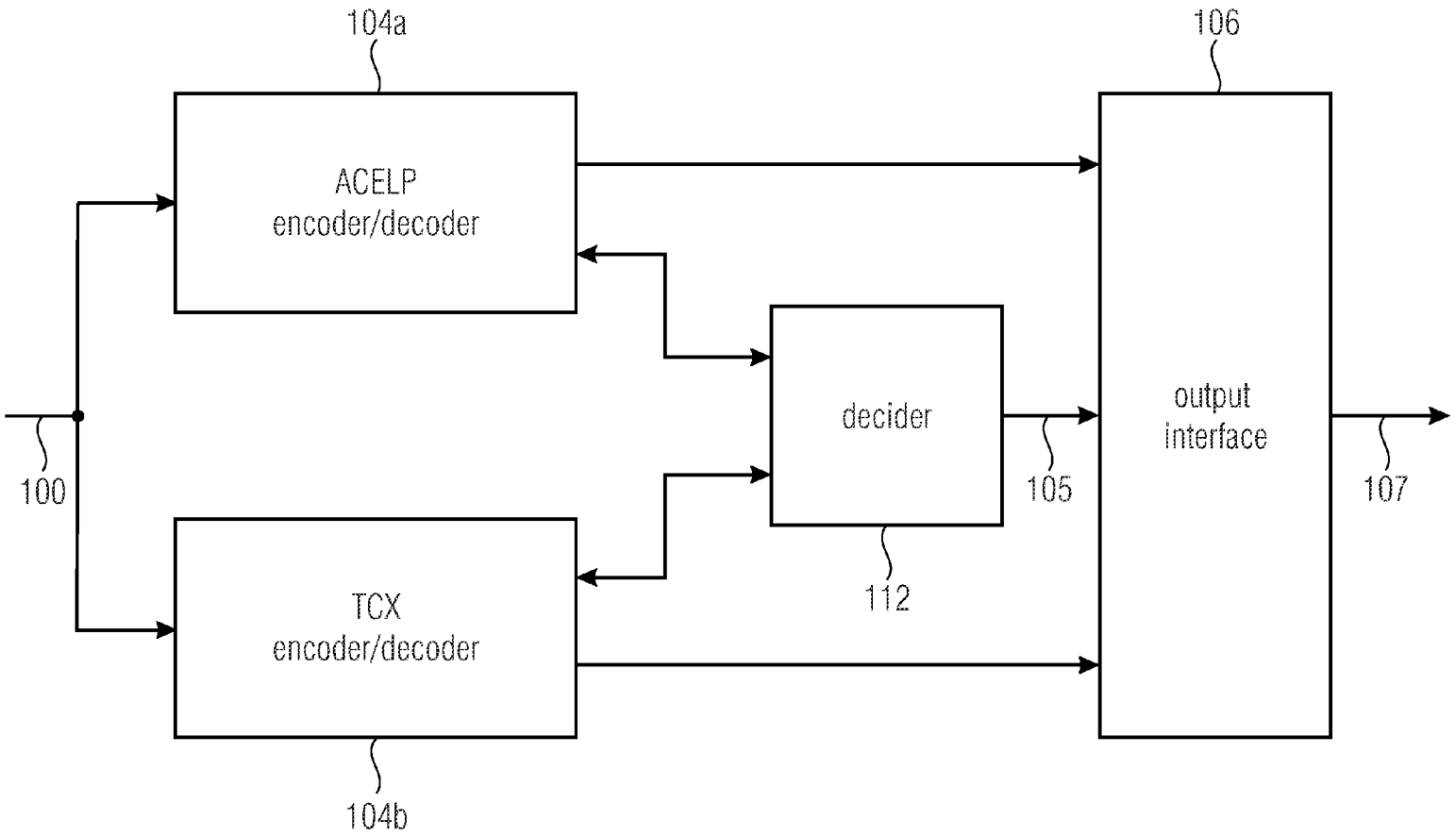
FIG. 3*c* illustrates a further embodiment for deciding between the modes for each frame.

FIG. 3*b* illustrates more details on the concept of FIG. 3*c*. Particularly, block 104*a* comprises a complete ACELP encoder and a complete ACELP decoder and a comparator 112*a*. The comparator 112*a* provides a quality measure to comparator 112*c*. The same is true for comparator 112*b*, which has a quality measure due to the comparison of a TCX encoded and again decoded signal with the original audio signal. Subsequently, both comparators 112*a*, 112*b* provide their quality measures to the final comparator 112*c*. Depending on which quality measure is better, the comparator decides on a CELP or TCX decision. The decision can be refined by introducing additional factors into the decision.

Alternatively, an open-loop mode for determining the coding mode for a current frame based on the signal analysis of the audio data for the current frame can be performed. In this case, the decider 112 of FIG. 3*c* would perform a signal analysis of the audio data for the current frame and would then either control an ACELP encoder or a TCX encoder to actually encode the current audio frame. In this situation, the encoder would not need a complete decoder, but an implementation of the encoding steps alone within the encoder would be sufficient. Open-loop signal classifications and signal decisions are, for example, also described in AMR-WB+ (3GPP TS 26.290).

Figure 2A:
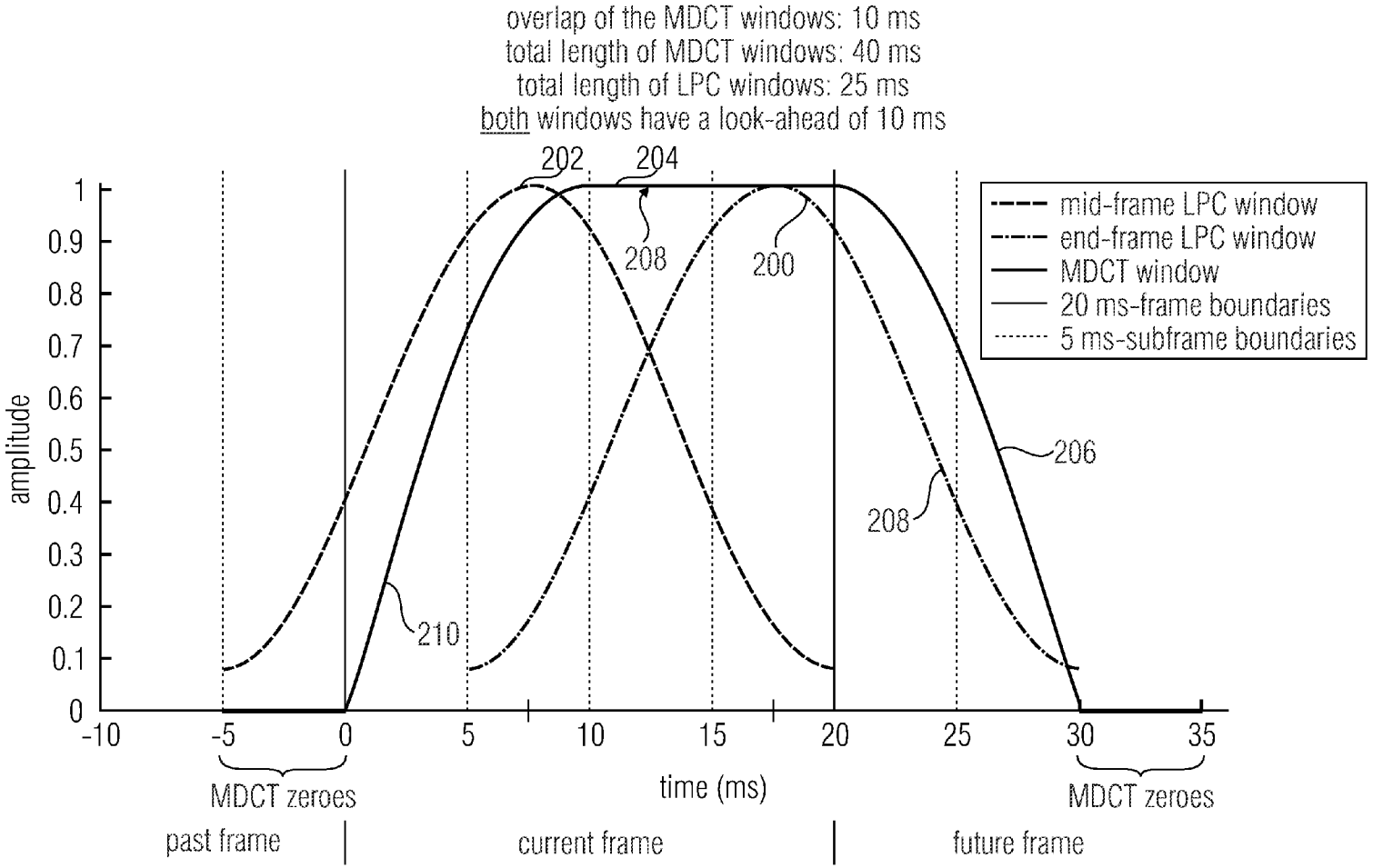
FIG. 2*a* illustrates an embodiment for the windower applied in the encoder for LPC analysis on the one hand and transform coding analysis on the other hand, and is a representation of the synthesis window used in the transform coding decoder of FIG. 1*b;*

FIG. 2*a* illustrates an advantageous implementation of the windower 102 and, particularly, the windows supplied by the windower.

Advantageously, the prediction coding analysis window for the current frame is centered at the center of a fourth subframe and this window is indicated at 200. Furthermore, it is of advantage to use an additional LPC analysis window, i.e., the mid-frame LPC analysis window indicated at 202 and centered at the center of the second subframe of the current frame. Furthermore, the transform coding window such as, for example, the MDCT window 204 is placed with respect to the two LPC analysis windows 200, 202 as illustrated. Particularly, the look-ahead portion 206 of the analysis window has the same length in time as the look-ahead portion 208 of the prediction coding analysis window. Both look-ahead portions extend 10 ms into the future frame. Furthermore, it is of advantage that the transform coding analysis window not only has the overlap portion 206, but has a non-overlap portion between 10 and 20 ms 208 and the first overlap portion 210. The overlap portions 206 and 210 are so that an overlap-adder in a decoder performs an overlap-add processing in the overlap portion, but an overlap-add procedure is not necessary for the non-overlap portion.

Advantageously, the first overlap portion 210 starts at the beginning of the frame, i.e., at zero ms and extends until the center of the frame, i.e., 10 ms. Furthermore, the non-overlap portion extends from the end of the first portion of the frame 210 until the end of the frame at 20 ms so that the second overlap portion 206 fully coincides with the look-ahead portion. This has advantages due to switching from one mode to the other mode.. From a TCX performance point of view, it would be better to use a sine window with full overlap (20 ms overlap, like in USAC). This would, however, necessitate a technology like forward aliasing cancellation for the transitions between TCX and ACELP. Forward aliasing cancellation is used in USAC to cancel the aliasing introduced by the missing next TCX frames (replaced by ACELP). Forward aliasing cancellation necessitates a significant amount of bits and thus is not suitable for a constant bitrate and, particularly, low-bitrate codec like an embodiment of the described codec. Therefore, in accordance with the embodiments of the invention, instead of using FAC, the TCX window overlap is reduced and the window is shifted towards the future so that the full overlap portion 206 is placed in the future frame. Furthermore, the window illustrated in FIG. 2*a* for transform coding has nevertheless a maximum overlap in order to receive perfect reconstruction in the current frame, when the next frame is ACELP and without using forward aliasing cancellation. This maximum overlap may be set to 10 ms which is the available look-ahead in time, i.e., 10 ms as becomes clear from FIG. 2*a*.

Although FIG. 2*a* has been described with respect to an encoder, where window 204 for transform encoding is an analysis window, it is noted that window 204 also represents a synthesis window for transform decoding. In an embodiment, the analysis window is identical to the synthesis window, and both windows are symmetric in itself. This means that both windows are symmetric to a (horizontal) center line. In other applications, however, non-symmetric windows can be used, where the analysis window is different in shape than the synthesis window.

Figure 2B:
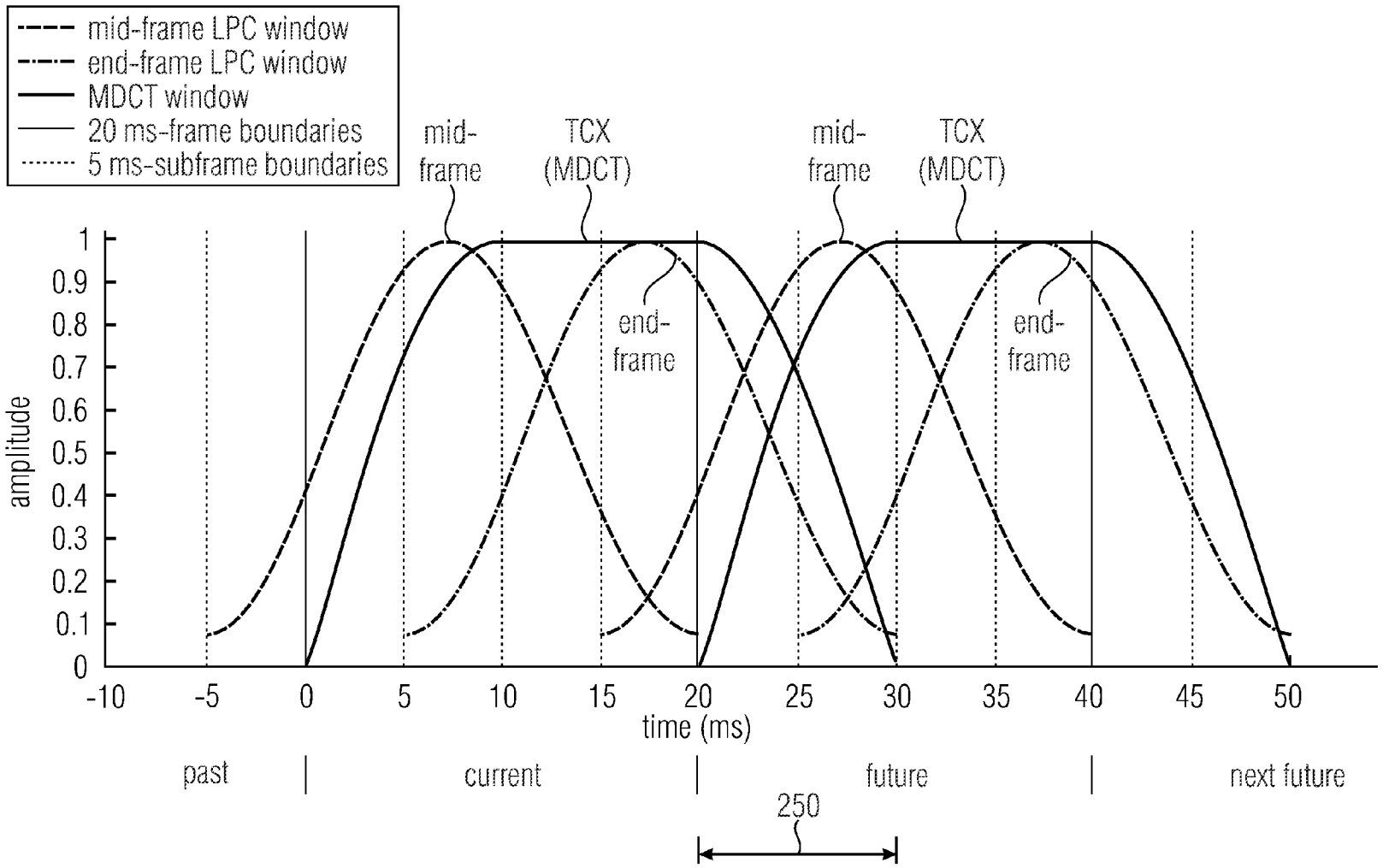
FIG. 2*b* illustrates a window sequence of aligned LPC analysis windows and TCX windows for a time span of more than two frames.

FIG. 2*b* illustrates a sequence of windows over a portion of a past frame, a subsequently following current frame, a future frame which is subsequently following the current frame and the next future frame which is subsequently following the future frame.

It becomes clear that the overlap-add portion processed by an overlap-add processor illustrated at 250 extends from the beginning of each frame until the middle of each frame, i.e., between 20 and 30 ms for calculating the future frame data and between 40 and 50 ms for calculating TCX data for the next future frame or between zero and 10 ms for calculating data for the current frame. However, for calculating the data in the second half of each frame, no overlap-add, and therefore no forward aliasing cancellation technique is necessary. This is due to the fact that the synthesis window has a non-overlap part in the second half of each frame.

Typically, the length of an MDCT window is twice the length of a frame. This is the case in the present invention as well. When, again, FIG. 2*a* is considered, however, it becomes clear that the analysis/synthesis window only extends from zero to 30 ms, but the complete length of the window is 40 ms. This complete length is significant for providing input data for the corresponding folding or unfolding operation of the MDCT calculation. In order to extend the window to a full length of 14 ms, 5 ms of zero values are added between −5 and 0 ms and 5 seconds of MDCT zero values are also added at the end of the frame between 30 and 35 ms. This additional portions only having zeros, however, do not play any part when it comes to delay considerations, since it is known to the encoder or decoder that the last five ms of the window and the first five ms of the window are zeros, so that this data is already present without any delay.

Figure 2C:
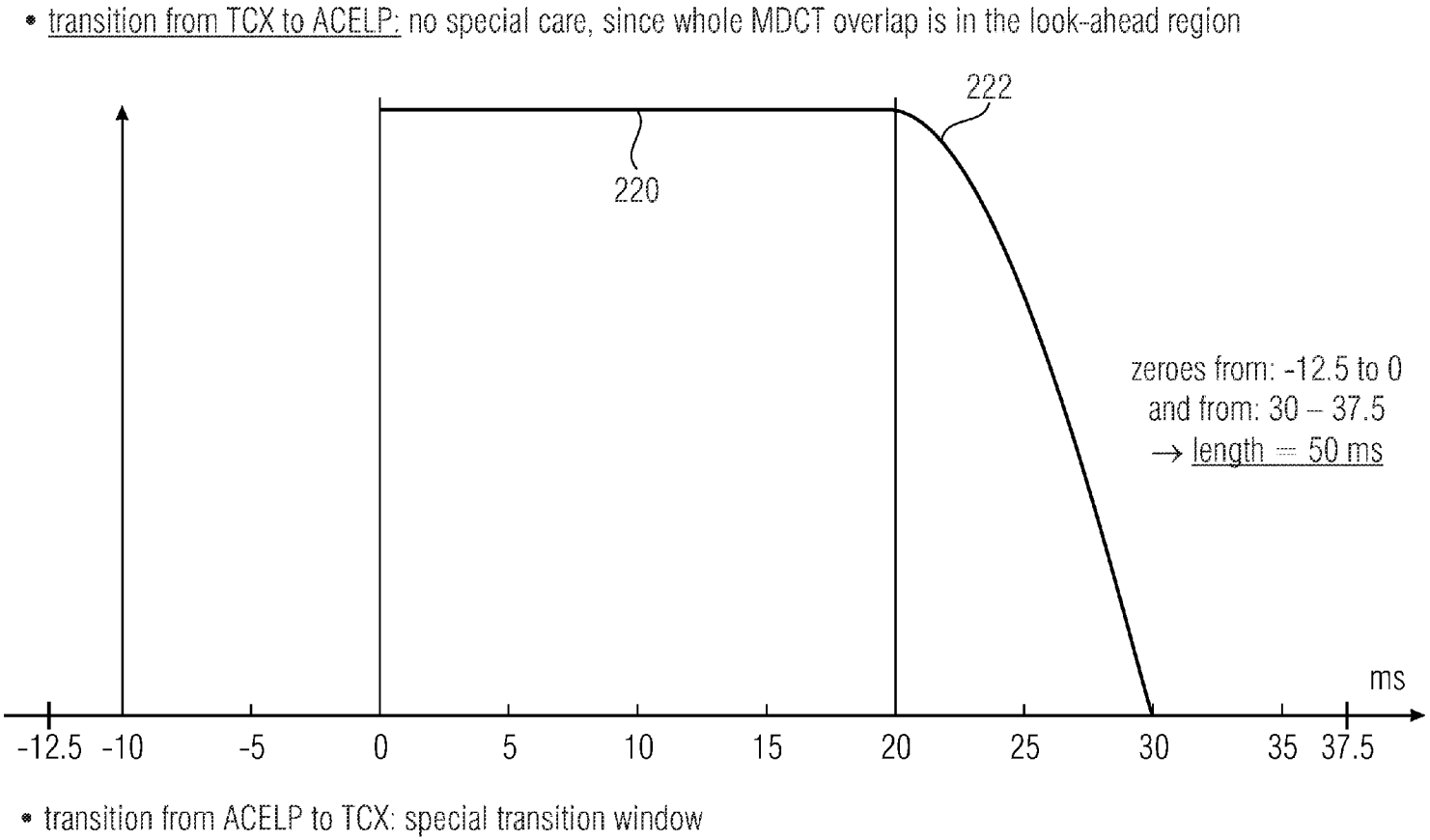
FIG. 2*c* illustrates a situation for a transition from TCX to ACELP and a transition window for a transition from ACELP to TCX.

FIG. 2*c* illustrates the two possible transitions. For a transition from TCX to ACELP, however, no special care has to be taken since, when it is assumed with respect to FIG. 2*a* that the future frame is an ACELP frame, then the data obtained by TCX decoding the last frame for the look-ahead portion 206 can simply be deleted, since the ACELP frame immediately starts at the beginning of the future frame and, therefore, no data hole exists. The ACELP data is self-consistent and, therefore, a decoder, when having a switch from TCX to ACELP uses the data calculated from TCX for the current frame, discards the data obtained by the TCX processing for the future frame and, instead, uses the future frame data from the ACELP branch.

When, however, a transition from ACELP to TCX is performed, then a special transition window as illustrated in FIG. 2*c* is used. This window starts at the beginning of the frame from zero to 1, has a non-overlap portion 220 and has an overlap portion in the end indicated at 222 which is identical to the overlap portion 206 of a straightforward MDCT window.

This window is, additionally, padded with zeros between −12.5 ms to zero at the beginning of the window and between 30 and 35.5 ms at the end, i.e., subsequent to the look-ahead portion 222. This results in an increased transform length. The length is 50 ms, but the length of the straightforward analysis/synthesis window is only 40 ms. This, however, does not decrease the efficiency or increase the bitrate, and this longer transform is necessitated when a switch from ACELP to TCX takes place. The transition window used in the corresponding decoder is identical to the window illustrated in FIG. 2*c*.

Figure 1B:
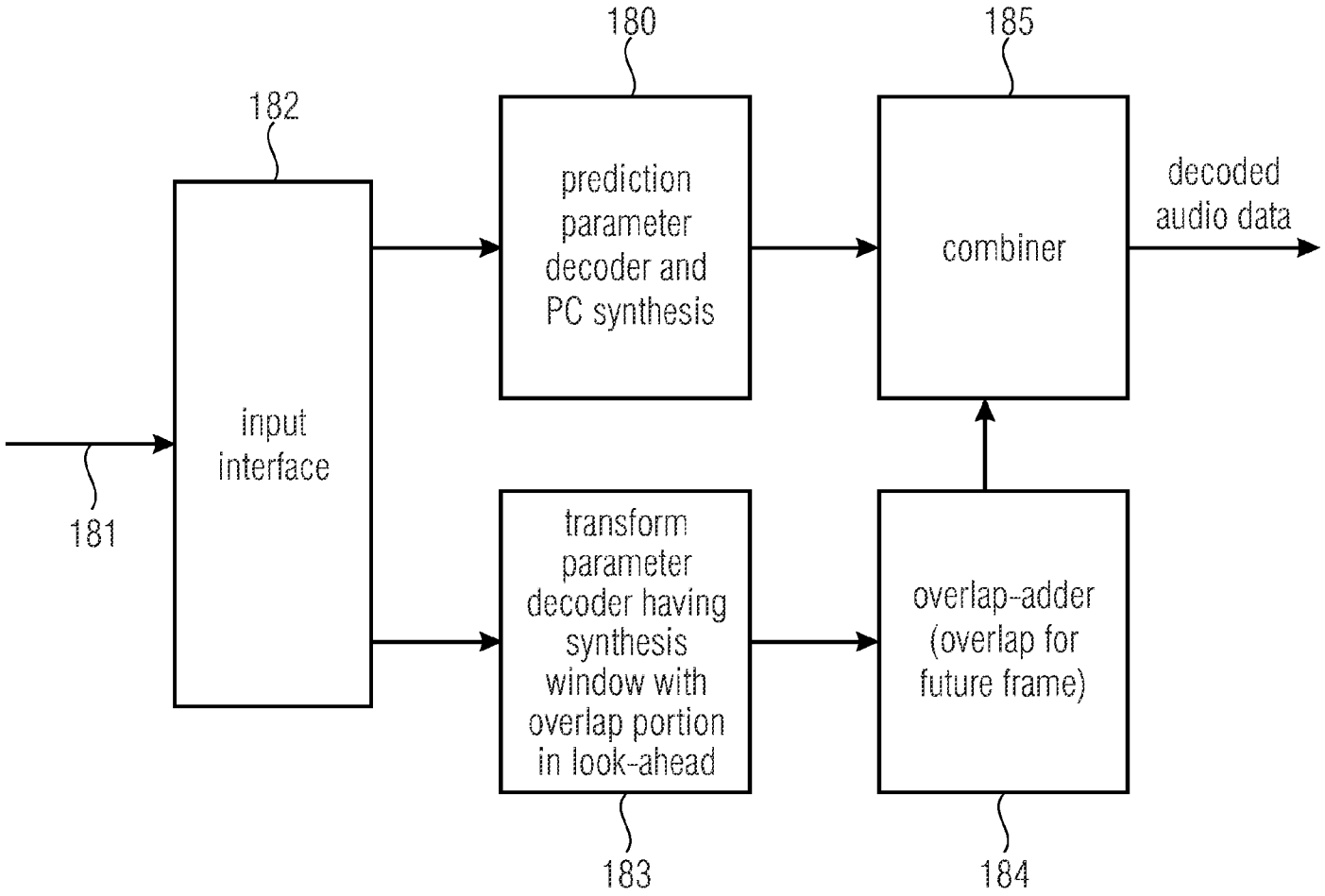
FIG. 1*b* illustrates a block diagram of a corresponding switched decoder.

Subsequently, the decoder is discussed in more detail. FIG. 1*b* illustrates an audio decoder for decoding an encoded audio signal. The audio decoder comprises a prediction parameter decoder 180, where the prediction parameter decoder is configured for performing a decoding of data for a prediction coded frame from the encoded audio signal received at 181 and being input into an interface 182. The decoder additionally comprises a transform parameter decoder 183 for performing a decoding of data for a transform coded frame from the encoded audio signal on line 181. The transform parameter decoder is configured for performing, advantageously, an aliasing-affected spectral-time transform and for applying a synthesis window to transformed data to obtain data for the current frame and a future frame. The synthesis window has a first overlap portion, an adjacent second non-overlap portion, and an adjacent third overlap portion as illustrated in FIG. 2*a*, wherein the third overlap portion is only associated with audio samples for the future frame and the non-overlap portion is only associated with data of the current frame. Furthermore, an overlap-adder 184 is provided for overlapping and adding synthesis window samples associated with the third overlap portion of a synthesis window for the current frame and a synthesis window at the samples associated with the first overlap portion of a synthesis window for the future frame to obtain a first portion of audio samples for the future frame. The rest of the audio samples for the future frame are synthesis windowed samples associated with the second non-overlap portion of the synthesis window for the future frame obtained without overlap-adding when the current frame and the future frame comprise transform coded data. When, however, a switch takes place from one frame to the next frame, a combiner 185 is useful which has to care for a good switchover from one coding mode to the other coding mode in order to finally obtain the decoded audio data at the output of the combiner 185.

Figure 1C:
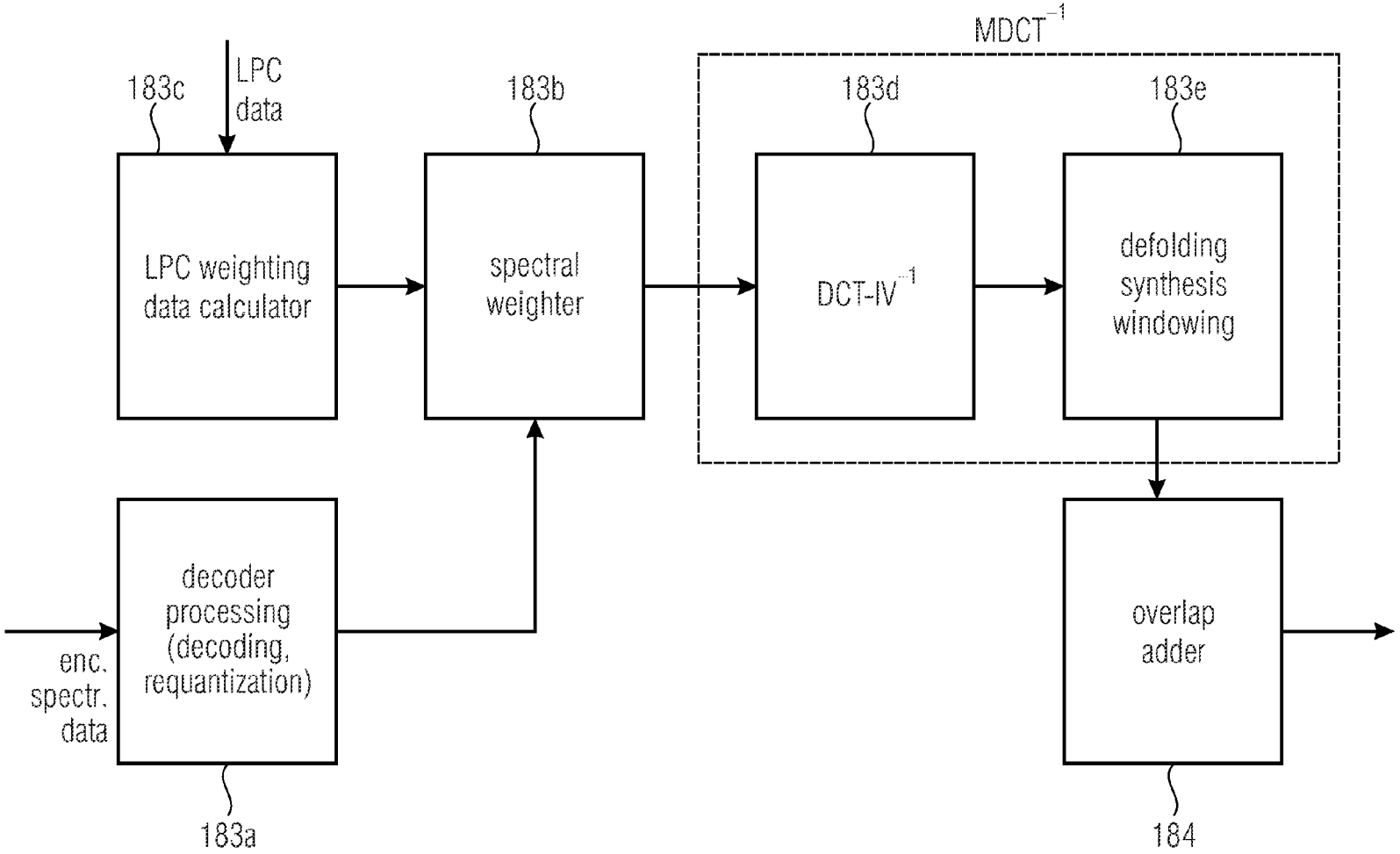
FIG. 1*c* illustrates more details on the transform parameter decoder illustrated in FIG. 1*b;*

FIG. 1*c* illustrates more details on the construction of the transform parameter decoder 183.

The decoder comprises a decoder processing stage 183*a* which is configured for performing all processing necessitated for decoding encoded spectral data such as arithmetic decoding or Huffman decoding or generally, entropy decoding and a subsequent de-quantization, noise filling, etc. to obtain decoded spectral values at the output of block 183. These spectral values are input into a spectral weighter 183*b*. The spectral weighter 183*b* receives the spectral weighting data from an LPC weighting data calculator 183*c*, which is fed by LPC data generated from the prediction analysis block on the encoder-side and received, at the decoder, via the input interface 182. Then, an inverse spectral transform is performed which may comprise, as a first stage, a DCT-IV inverse transform 183*d* and a subsequent defolding and synthesis windowing processing 183*e*, before the data for the future frame, for example, is provided to the overlap-adder 184. The overlap-adder can perform the overlap-add operation when the data for the next future frame is available. Blocks 183*d* and 183*e* together constitute the spectral/time transform or, in the embodiment in FIG. 1*c*, an MDCT inverse transform ($MDCT^{-1}$).

Particularly, the block 183*d* receives data for a frame of 20 ms, and increases the data volume in the defolding step of block 183*e* into data for 40 ms, i.e., twice the amount of the data from before and, subsequently, the synthesis window having a length of 40 ms (when the zero portions at the beginning and the end of the window are added together) is applied to these 40 ms of data. Then, at the output of block 183*e*, the data for the current block and the data within the look-ahead portion for the future block are available.

Figure 1D:
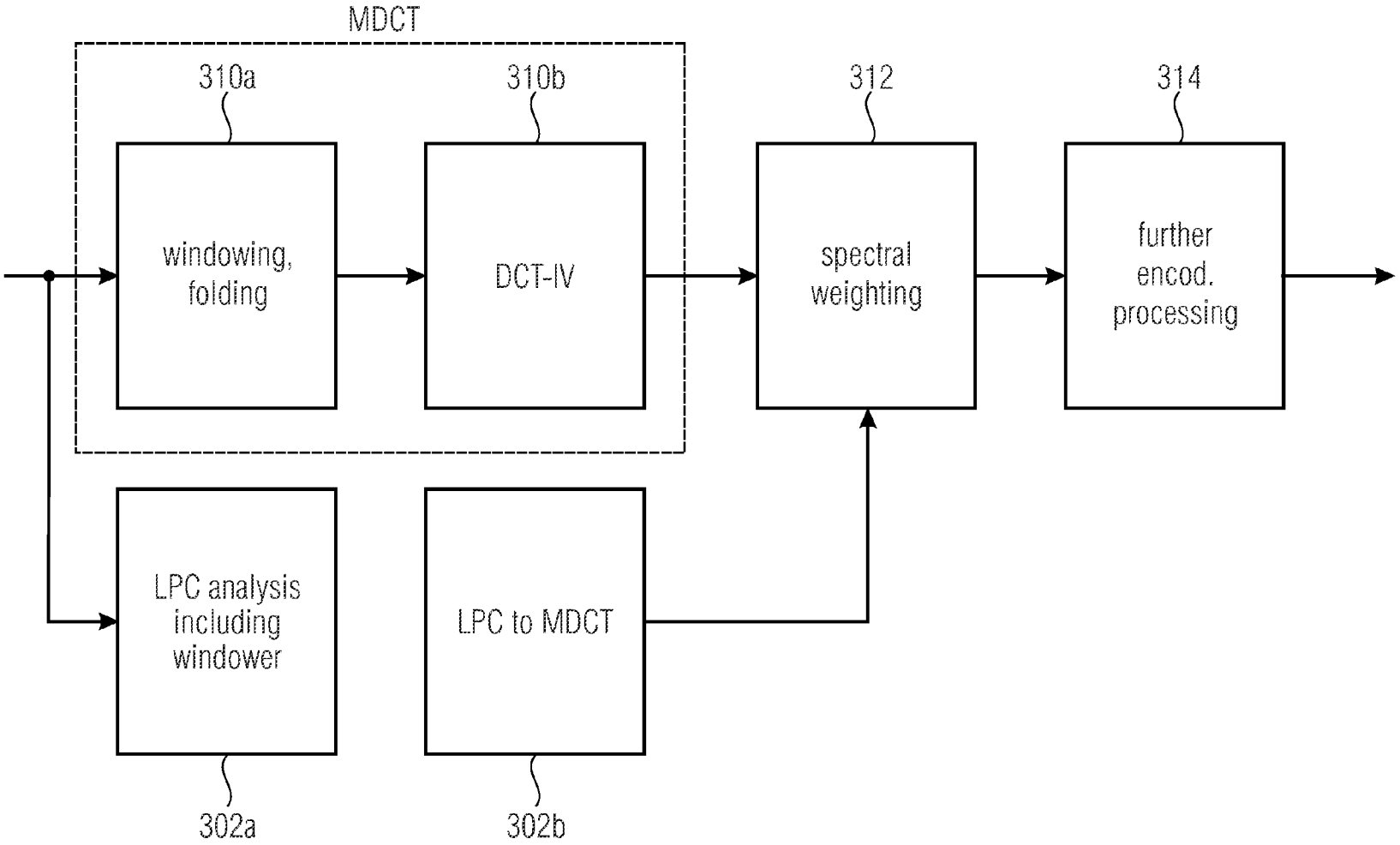
FIG. 1*d* illustrates more details on the transform coding mode of the decoder of FIG. 1*a;*

FIG. 1*d* illustrates the corresponding encoder-side processing. The features discussed in the context of FIG. 1*d* are implemented in the encoding processor 104 or by corresponding blocks in FIG. 3*a*. The time-frequency conversion 310 in FIG. 3*a* may be implemented as an MDCT and comprises a windowing, folding stage 310*a*, where the windowing operation in block 310*a* is implemented by the TCX windower 103*d*. Hence, the actually first operation in block 310 in FIG. 3*a* is the folding operation in order to bring back 40 ms of input data into 20 ms of frame data. Then, with the folded data which now has received aliasing contributions, a DCT-IV is performed as illustrated in block 310*d*. Block 302 (LPC analysis) provides the LPC data derived from the analysis using the end-frame LPC window to an (LPC to MDCT) block 302*b*, and the block 302*d* generates weighting factors for performing spectral weighting by spectral weighter 312. Advantageously, 16 LPC coefficients for one frame of 20 ms in the TCX encoding mode are transformed into 16 MDCT-domain weighting factors, advantageously by using an oDFT (odd Discrete Fourier Transform). For other modes, such as the NB modes having a sampling rate of 8 kHz, the number of LPC coefficients can be lower such as 10. For other modes with a higher sampling rates, there can also be more than 16 LPC coefficients. The result of this oDFT are 16 weighting values, and each weighting value is associated with a band of spectral data obtained by block 310*b*. The spectral weighting takes place by dividing all MDCT spectral values for one band by the same weighting value associated with this band in order to very efficiently perform this spectral weighting operation in block 312. Hence, 16 bands of MDCT values are each divided by the corresponding weighting factor in order to output the spectrally weighted spectral values which are then further processed by block 314 as known in the art, i.e., by, for example, quantizing and entropy-encoding.

On the other hand, on the decoder-side, the spectral weighting corresponding to block 312 in FIG. 1*d* will be a multiplication performed by spectral weighter 183*b* illustrated in FIG. 1*c*.

Figure 4A:
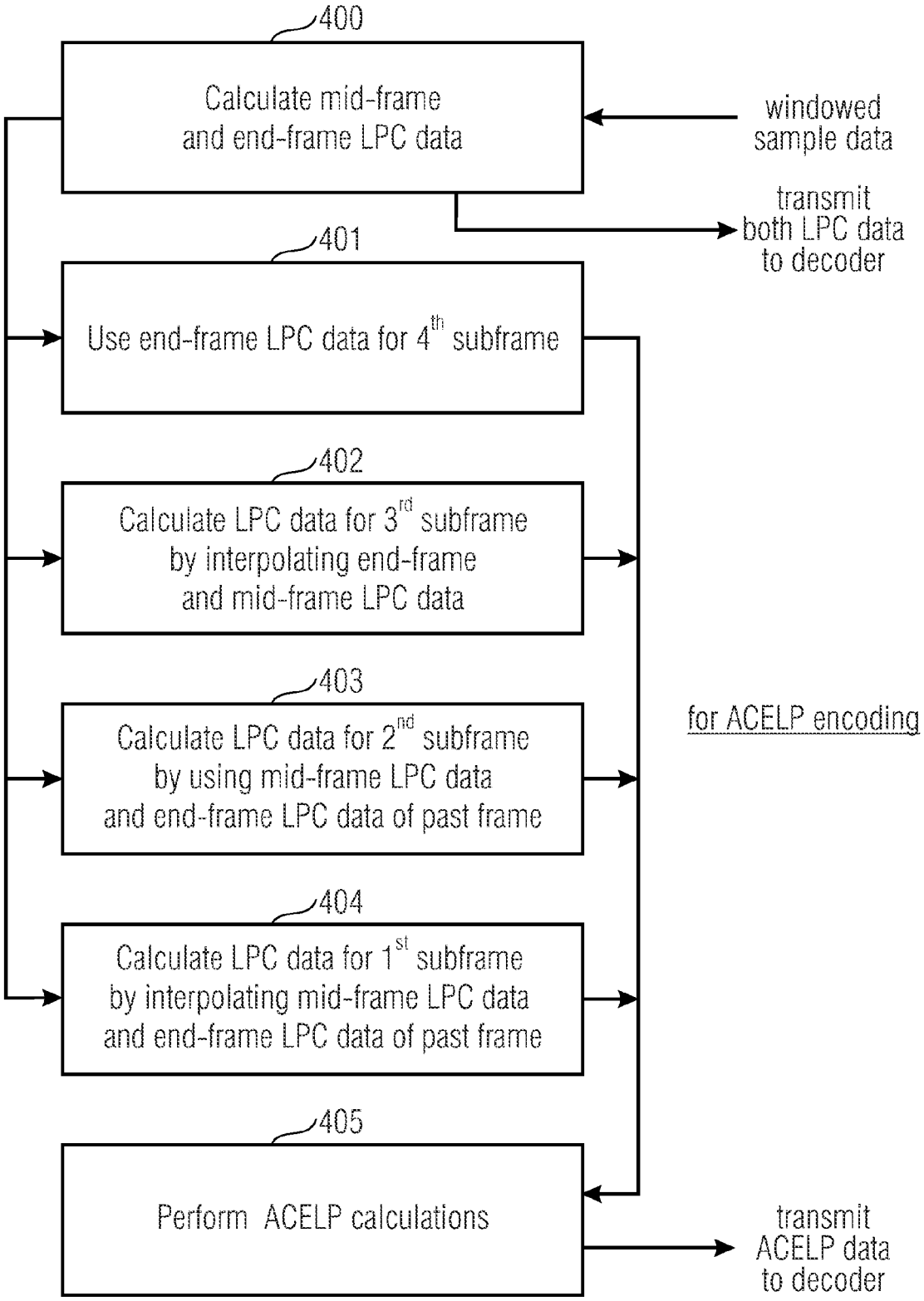
FIG. 4*a* illustrates the calculation and usage of the LPC data derived by using two different LPC analysis windows for a current frame.
Figure 4B:
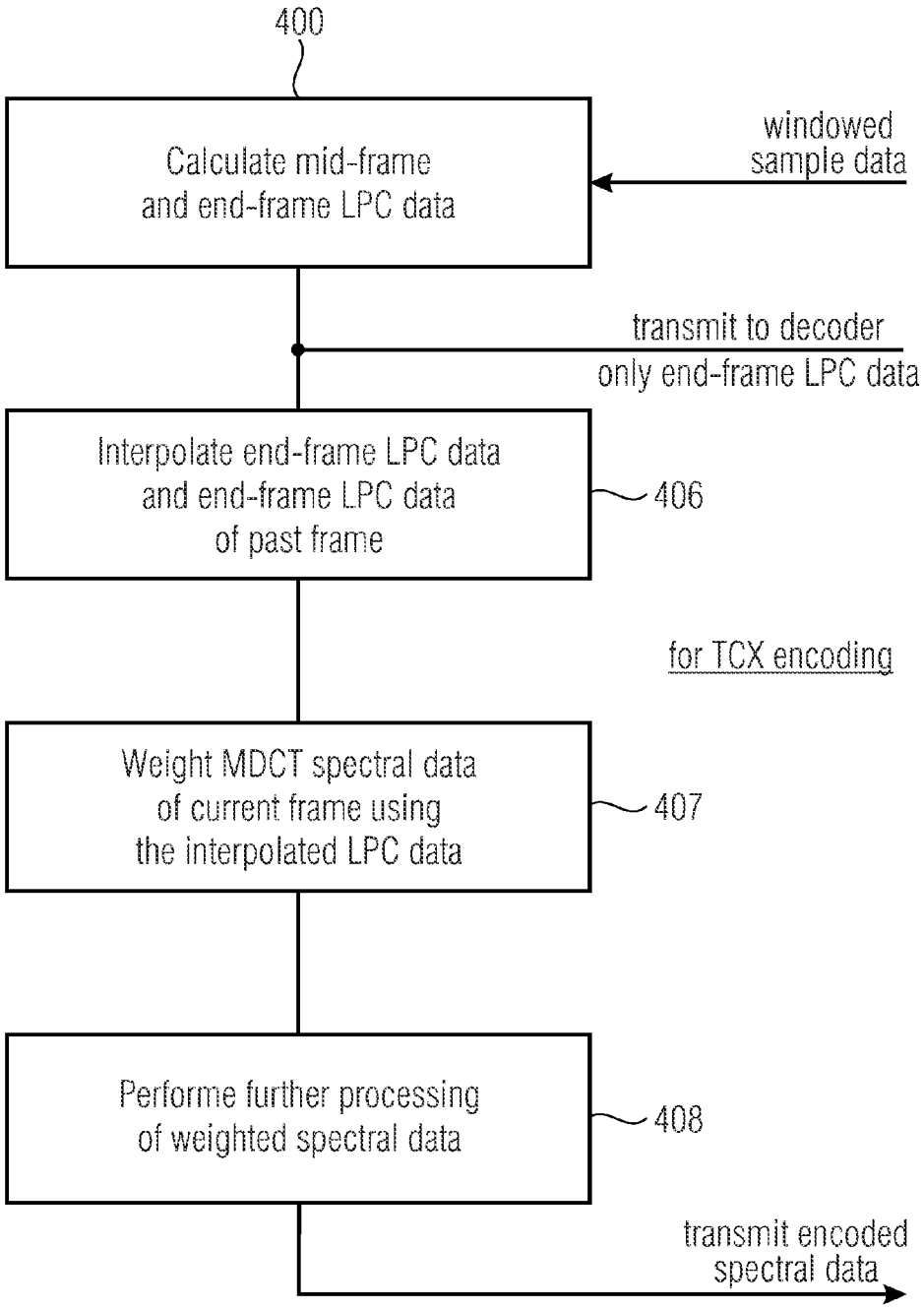
FIG. 4*b* illustrates the usage of LPC data obtained by windowing using an LPC analysis window for the TCX branch of the encoder.
Figure 5A:
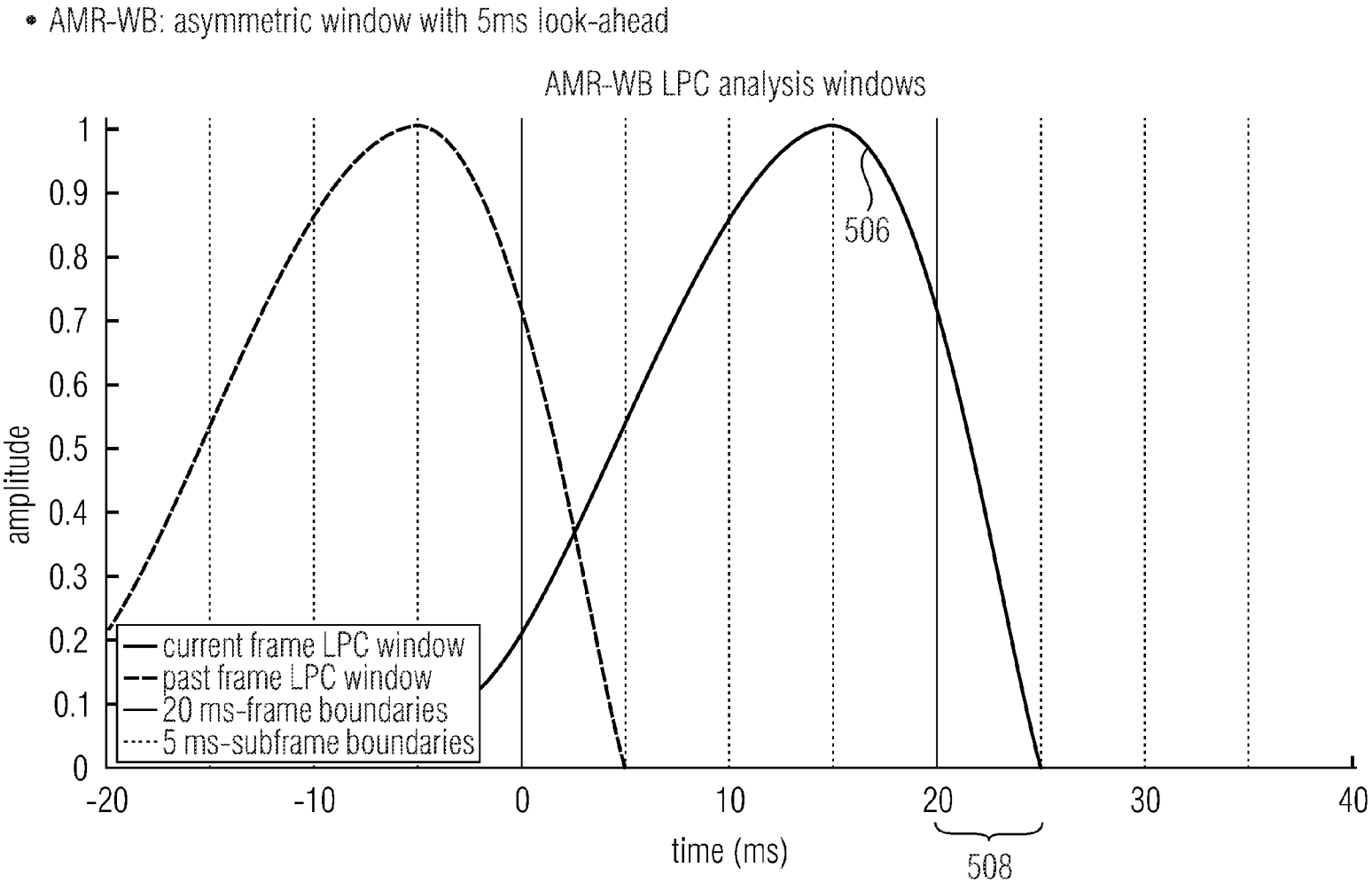
FIG. 5*a* illustrates LPC analysis windows for AMR-WB.
Figure 5B:
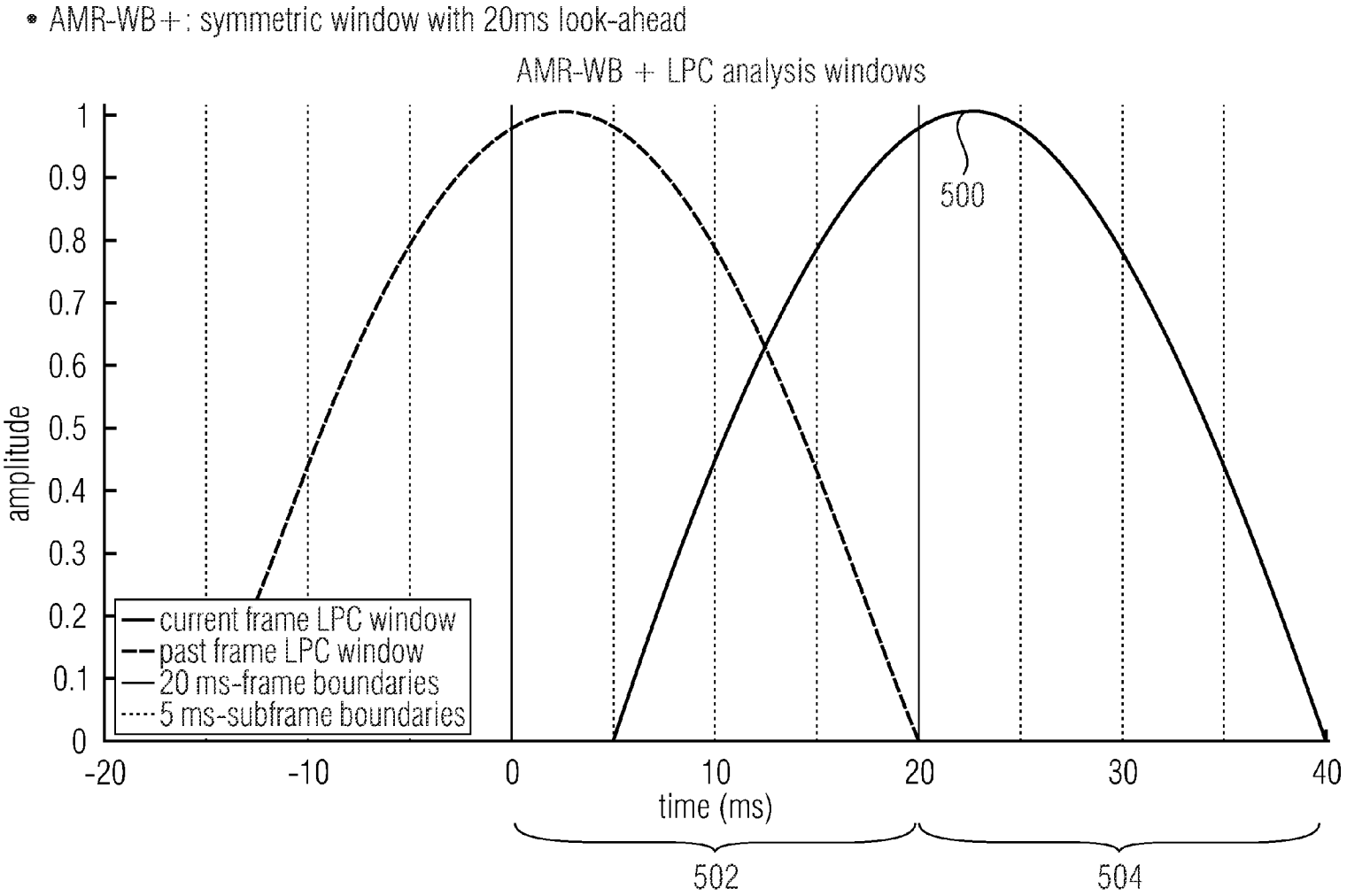
FIG. 5*b* illustrates symmetric windows for AMR-WB+ for the purpose of LPC analysis.
Figure 5C:
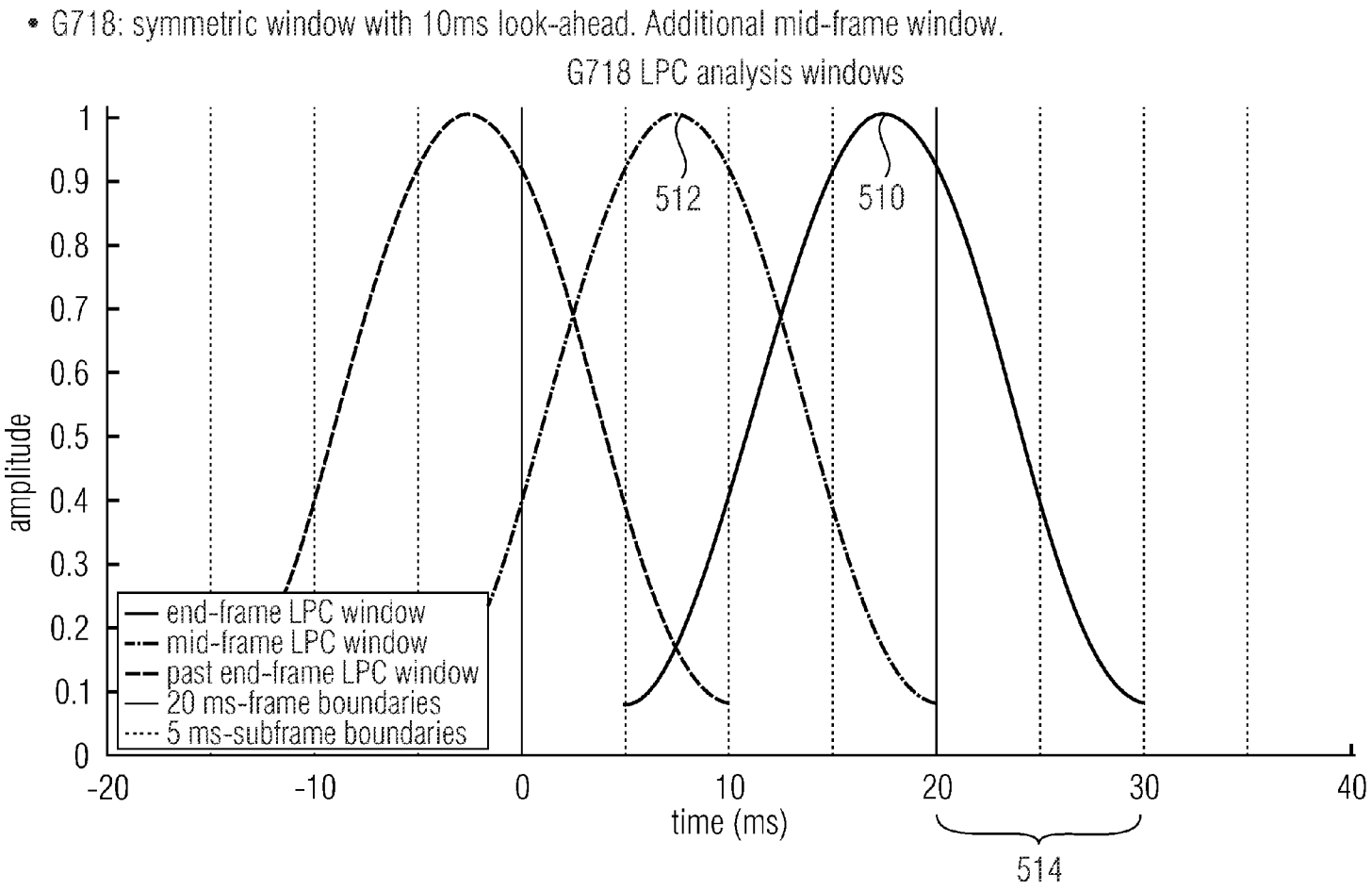
FIG. 5*c* illustrates LPC analysis windows for a G.718 encoder.
Figure 5D:
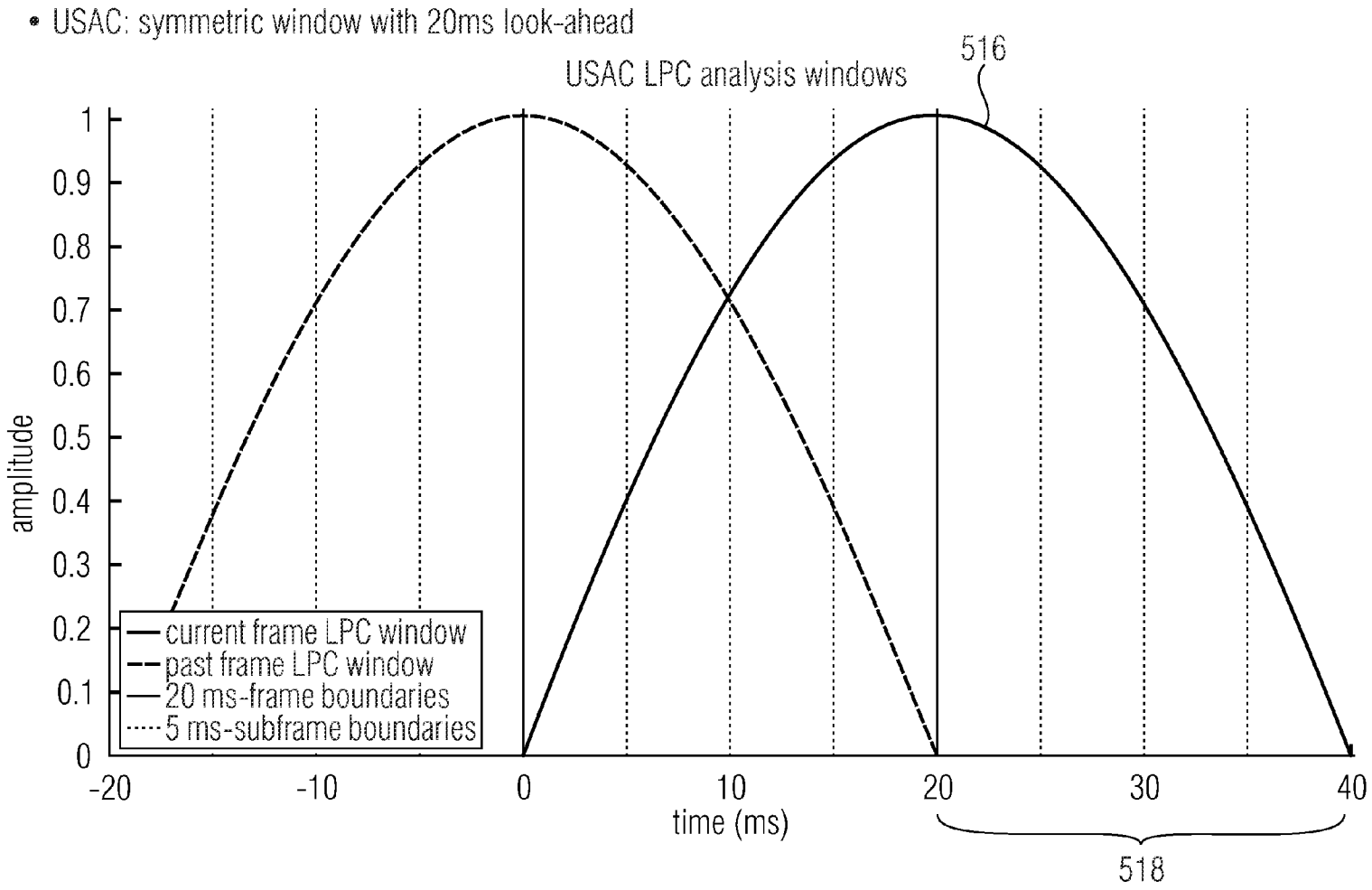
FIG. 5*d* illustrates LPC analysis windows as used in USAC.
Figure 6:
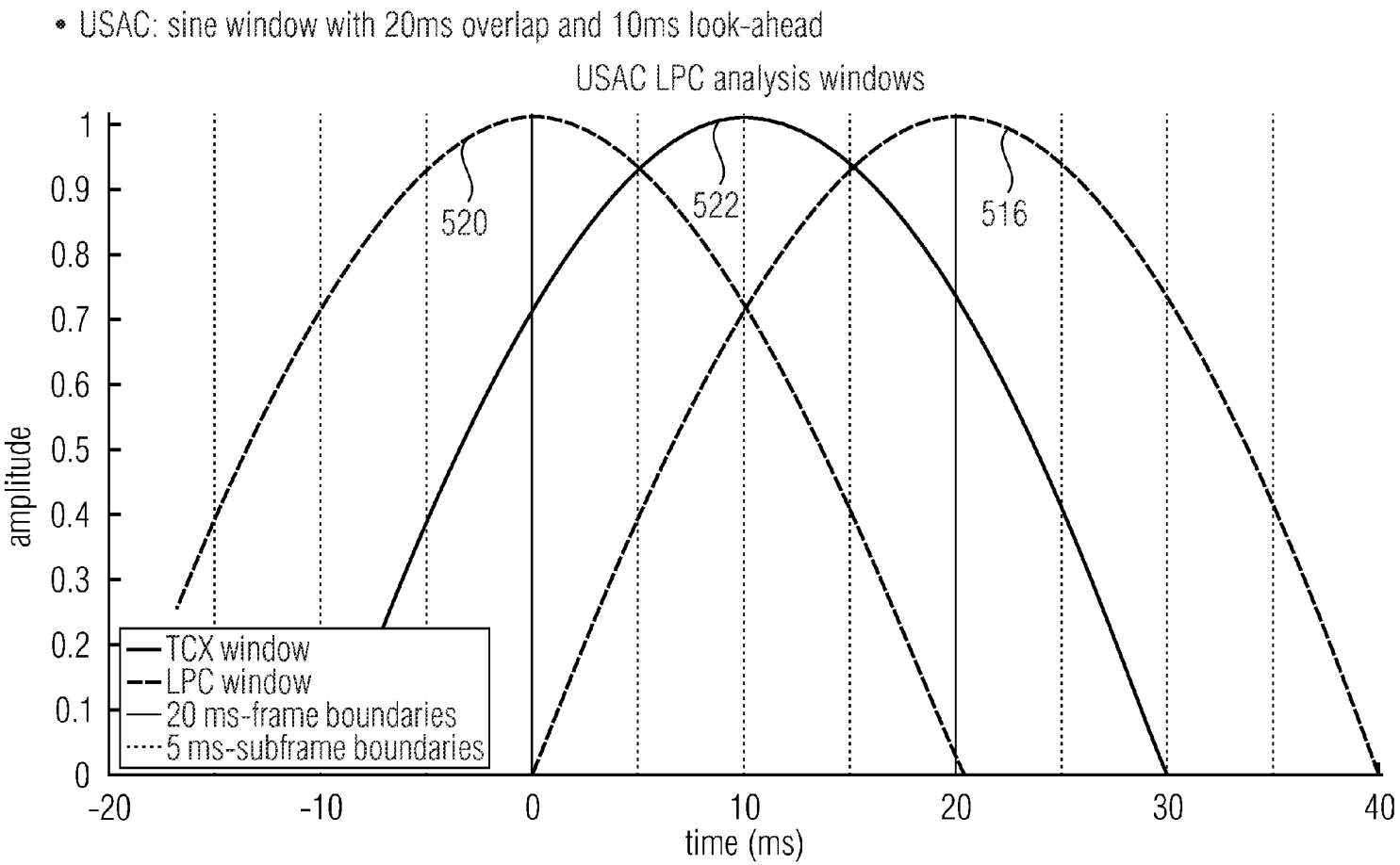
FIG. 6 illustrates a TCX window for a current frame with respect to an LPC analysis window for the current frame.

Subsequently, FIG. 4*a* and FIG. 4*b* are discussed in order to outline how the LPC data generated by the LPC analysis window or generated by the two LPC analysis windows illustrated in FIG. 2 are used either in ACELP mode or in TCX/MDCT mode.

Subsequent to the application of the LPC analysis window, the autocorrelation computation is performed with the LPC windowed data. Then, a Levinson Durbin algorithm is applied on the autocorrelation function. Then, the 16 LP coefficients for each LP analysis, i.e., 16 coefficients for the mid-frame window and 16 coefficients for the end-frame window are converted into ISP values. Hence, the steps from the autocorrelation calculation to the ISP conversion are, for example, performed in block 400 of FIG. 4*a*. Then, the calculation continues, on the encoder side by a quantization of the ISP coefficients. Then, the ISP coefficients are again unquantized and converted back to the LP coefficient domain. Hence, LPC data or, stated differently, 16 LPC coefficients slightly different from the LPC coefficients derived in block 400 (due to quantization and requantization) are obtained which can then be directly used for the fourth subframe as indicated in step 401. For the other subframes, however, it is of advantage to perform several interpolations as, for example, outlined in section 6.8.3 of Rec. ITU-T G.718 (06/2008). LPC data for the third subframe are calculated by interpolating end-frame and mid-frame LPC data illustrated at block 402. An advantageous interpolation is that each corresponding data are divided by two and added together, i.e., an average of the end-frame and mid-frame LPC data. In order to calculate the LPC data for the second subframe as illustrated in block 403, additionally, an interpolation is performed. Particularly, 10% of the values of the end-frame LPC data of the last frame, 80% of the mid-frame LPC data for the current frame and 10% of the values of the LPC data for the end-frame of the current frame are used in order to finally calculate the LPC data for the second subframe.

Finally, the LPC data for the first subframe are calculated, as indicated in block 404, by forming an average between the end-frame LPC data of the last frame and the mid-frame LPC data of the current frame.

For performing the ACELP encoding, both quantized LPC parameter sets, i.e., from the mid-frame analysis and the end-frame analysis are transmitted to a decoder.

Based on the results for the individual subframes calculated by blocks 401 to 404, the ACELP calculations are performed as indicated in block 405 in order to obtain the ACELP data to be transmitted to the decoder.

Subsequently, FIG. 4*b* is described. Again, in block 400, mid-frame and end-frame LPC data are calculated. However, since there is the TCX encoding mode, only the end-frame LPC data are transmitted to the decoder and the mid-frame LPC data are not transmitted to the decoder. Particularly, one does not transmit the LPC coefficients themselves to the decoder, but one transmits the values obtained after ISP transform and quantization. Hence, it is of advantage that, as LPC data, the quantized ISP values derived from the end-frame LPC data coefficients are transmitted to the decoder.

In the encoder, however, the procedures in steps 406 to 408 are, nevertheless, to be performed in order to obtain weighting factors for weighting the MDCT spectral data of the current frame. To this end, the end-frame LPC data of the current frame and the end-frame LPC data of the past frame are interpolated. However, it is of advantage to not interpolate the LPC data coefficients themselves as directly derived from the LPC analysis. Instead, it is of advantage to interpolate the quantized and again dequantized ISP values derived from the corresponding LPC coefficients. Hence, the LPC data used in block 406 as well as the LPC data used for the other calculations in block 401 to 404 are, advantageously, quantized and again de-quantized ISP data derived from the original 16 LPC coefficients per LPC analysis window.

The interpolation in block 406 may be a pure averaging, i.e., the corresponding values are added and divided by two. Then, in block 407, the MDCT spectral data of the current frame are weighted using the interpolated LPC data and, in block 408, the further processing of weighted spectral data is performed in order to finally obtain the encoded spectral data to be transmitted from the encoder to a decoder. Hence, the procedures performed in the step 407 correspond to the block 312, and the procedure performed in block 408 in FIG. 4*d* corresponds to the block 314 in FIG. 4*d*. The corresponding operations are actually performed on the decoder-side. Hence, the same interpolations are necessitated on the decoder-side in order to calculate the spectral weighting factors on the one hand or to calculate the LPC coefficients for the individual subframes by interpolation on the other hand. Therefore, FIG. 4*a* and FIG. 4*b* are equally applicable to the decoder-side with respect to the procedures in blocks 401 to 404 or 406 of FIG. 4*b*.

The present invention is particularly useful for low-delay codec implementations. This means that such codecs are designed to have an algorithmic or systematic delay advantageously below 45 ms and, in some cases even equal to or below 35 ms. Nevertheless, the look-ahead portion for LPC analysis and TCX analysis are necessitated for obtaining a good audio quality. Therefore, a good trade-off between both contradictory requirements is necessitated. It has been found that the good trade-off between delay on the one hand and quality on the other hand can be obtained by a switched audio encoder or decoder having a frame length of 20 ms, but it has been found that values for frame lengths between 15 and 30 ms also provide acceptable results. On the other hand, it has been found that a look-ahead portion of 10 ms is acceptable when it comes to delay issues, but values between 5 ms and 20 ms are also useful depending on the corresponding application. Furthermore, it has been found that the relation between look-ahead portion and the frame length is useful when it has the value of 0.5, but other values between 0.4 and 0.6 are useful as well. Furthermore, although the invention has been described with ACELP on the one hand and MDCT-TCX on the other hand, other algorithms operating in the time domain such as CELP or any other prediction or wave form algorithms are useful as well. With respect to TCX/MDCT, other transform domain coding algorithms such as an MDST, or any other transform-based algorithms can be applied as well.

The same is true for the specific implementation of LPC analysis and LPC calculation. It is of advantage to rely on the procedures described before, but other procedures for calculation/interpolation and analysis can be used as well, as long as those procedures rely on an LPC analysis window.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a non-transitory data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) may be used to perform some or all of the functionalities of the methods described herein. In some embodiments, a field programmable gate array may cooperate with a microprocessor in order to perform one of the methods described herein. Generally, the methods may be performed by any hardware apparatus.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

The invention claimed is:

1. An apparatus for encoding an audio signal comprising a stream of audio samples, comprising:

a windower for applying a prediction coding analysis window to the stream of audio samples to acquire windowed data for a prediction analysis and for applying a transform coding analysis window to the stream of audio samples to acquire windowed data for a transform analysis, wherein the transform coding analysis window is associated with audio samples within a current frame of audio samples and with audio samples of a predefined portion of a future frame of audio samples being a transform-coding look-ahead portion, wherein the prediction coding analysis window is associated with at least the portion of the audio samples of the current frame and with audio samples of a predefined portion of the future frame being a prediction coding look-ahead portion, wherein the transform coding look-ahead portion and the prediction coding look-ahead portion are identical to each other or are different from each other by less than 20% of the prediction coding look-ahead portion or less than 20% of the transform coding look-ahead portion; and an encoding processor for generating prediction coded data for the current frame using the windowed data for the prediction analysis or for generating transform coded data for the current frame using the windowed data for the transform analysis.

2. The apparatus of claim 1, wherein the transform coding analysis window comprises a non-overlapping portion extending in the transform-coding look-ahead portion.

3. The apparatus of claim 1, wherein the transform coding analysis window comprises a further overlapping portion starting at the beginning of the current frame and ending at the beginning of the non-overlapping portion.

4. The apparatus of claim 1, in which the windower is configured to only use a start window for the transition from prediction coding to transform coding from a frame to the next frame, wherein the start window is not used for a transition from transform coding to prediction coding from one frame to the next frame.

5. The apparatus in accordance with claim 1, further comprising:

an output interface for outputting an encoded signal for the current frame; and an encoding mode selector for controlling the encoding processor to output either prediction coded data or transform coded data for the current frame, wherein the encoding mode selector is configured to only switch between either prediction coding or transform coding for the whole frame so that the encoded signal for the whole frame either comprises prediction coded data or transform coded data.

6. The apparatus in accordance with claim 1, wherein the windower uses, in addition to the prediction coding analysis window, a further prediction coding analysis window being associated with audio samples being placed at the beginning of the current frame, and wherein the prediction coding analysis window is not associated with audio samples being placed at the beginning of the current frame.

7. The apparatus in accordance with claim 1, wherein the frame comprises a plurality of subframes, wherein the prediction analysis window is centered to a center of a subframe, and wherein the transform coding analysis window is centered to a border between two subframes.

8. The apparatus in accordance with claim 7, wherein the prediction analysis window is centered at the center of the last subframe of the frame, wherein the further analysis window is centered at a center of the second subframe of the current frame, and wherein the transform coding analysis window is centered at a border between the third and the fourth subframe of the current frame, wherein the current frame is subdivided into four subframes.

9. The apparatus in accordance with claim 1, wherein a further prediction coding analysis window does not comprise a look-ahead portion in the future frame and is associated with samples of the current frame.

10. The apparatus in accordance with claim 1, in which the transform coding analysis window additionally comprises a zero portion before a beginning of the window and a zero portion subsequent to an end of the window so that a full length in time of the transform coding analysis window is twice the length in time of the current frame.

11. The apparatus in accordance with claim 10, wherein, for a transition from the prediction coding mode to the transform coding mode from one frame to the next frame, a transition window is used by the windower, wherein the transition window comprises a first non-overlap portion starting at the beginning of the frame and an overlap portion starting at the end of the non-overlap portion and extending into the future frame, wherein the overlap portion extending into the future frame comprises a length which is identical to the length of the transform coding look-ahead portion of the analysis window.

12. The apparatus in accordance with claim 1, wherein a length in time of the transform coding analysis window is greater than a length in time of the prediction coding analysis window.

13. The apparatus in accordance with claim 1, further comprising:

an output interface for outputting an encoded signal for the current frame; and an encoding mode selector for controlling the encoding processor to output either prediction coded data or transform coded data for the current frame, wherein the window is configured to use a further prediction coding window located in the current frame before the prediction coding window, and wherein the encoding mode selector is configured to control the encoding processor to only forward prediction coding analysis data derived from the prediction coding window, when the transform coded data is output to the output interface and not to forward the prediction coding analysis data derived from the further prediction coding window, and wherein the encoding mode selector is configured to control the encoding processor to forward prediction coding analysis data derived from the prediction coding window and to forward the prediction coding analysis data derived from the further prediction coding window, when the prediction coded data is output to the output interface.

14. The apparatus in accordance with claim 1, wherein the encoding processor comprises:

a prediction coding analyzer for deriving prediction coding data for the current frame from the windowed data for a prediction analysis;

a prediction coding branch comprising:

a filter stage for calculating filter data from the audio samples for the current frame using the prediction coding data; and a prediction coder parameter calculator for calculating prediction coding parameters for the current frames; and a transform coding branch comprising:

a time-spectral converter for converting the window data for the transform coding algorithm into a spectral representation;

a spectral weighter for weighting the spectral data using weighted weighting data derived from the prediction coding data to acquire weighted spectral data; and a spectral data processor for processing the weighted spectral data to acquire transform coded data for the current frame.

15. A method of encoding an audio signal comprising a stream of audio samples, comprising:

applying a prediction coding analysis window to the stream of audio samples to acquire windowed data for a prediction analysis and applying a transform coding analysis window to the stream of audio samples to acquire windowed data for a transform analysis, wherein the transform coding analysis window is associated with audio samples within a current frame of audio samples and with audio samples of a predefined portion of a future frame of audio samples being a transform-coding look-ahead portion, wherein the prediction coding analysis window is associated with at least the portion of the audio samples of the current frame and with audio samples of a predefined portion of the future frame being a prediction coding look-ahead portion, wherein the transform coding look-ahead portion and the prediction coding look-ahead portion are identical to each other or are different from each other by less than 20% of the prediction coding look-ahead portion or less than 20% of the transform coding look-ahead portion; and generating prediction coded data for the current frame using the windowed data for the prediction analysis or for generating transform coded data for the current frame using the windowed data for the transform analysis.

16. An audio decoder for decoding an encoded audio signal, comprising:

a prediction parameter decoder for performing a decoding of data for a prediction coded frame from the encoded audio signal;

a transform parameter decoder for performing a decoding of data for a transform coded frame from the encoded audio signal, wherein the transform parameter decoder is configured for performing a spectral-time transform and for applying a synthesis window to transformed data to acquire data for the current frame and a future frame, the synthesis window comprising a first overlap portion, an adjacent second non-overlapping portion and an adjacent third overlap portion, the third overlap portion being associated with audio samples for the future frame and the non-overlap portion being associated with data of the current frame; and an overlap-adder for overlapping and adding synthesis windowed samples associated with the third overlap portion of a synthesis window for the current frame and synthesis windowed samples associated with the first overlap portion of a synthesis window for the future frame to acquire a first portion of audio samples for the future frame, wherein a rest of the audio samples for the future frame are synthesis windowed samples associated with the second non-overlapping portion of the synthesis window for the future frame acquired without overlap-adding, when the current frame and the future frame comprise transform-coded data.

17. The audio decoder of claim 16, wherein the current frame of the encoded audio signal comprises transform coded data and the future frame comprises prediction coded data, wherein the transform parameter decoder is configured to perform a synthesis windowing using the synthesis window for the current frame to acquire windowed audio samples associated with the non-overlap portion of the synthesis window, wherein the synthesis windowed audio samples associated with the third overlap portion of the synthesis window for the current frame are discarded, and wherein audio samples for the future frame are provided by the prediction parameter decoder without data from the transform parameter decoder.

18. The audio decoder of claim 16, wherein the current frame comprises prediction coding data and the future frame comprises transform coding data, wherein the transform parameter decoder is configured for using a transition window being different from the synthesis window, wherein the transition window comprises a first non-overlap portion at the beginning of the future frame and an overlap portion starting at an end of the future frame and extending into the frame following the future frame in time, and wherein the audio samples for the future frame are generated without an overlap and audio data associated with the second overlap portion of the window for the future frame are calculated by the overlap-adder using the first overlap portion of the synthesis window for the frame following the future frame.

19. The audio decoder of claim 16, in which the transform parameter calculator comprises:

a spectral weighter for weighting decoded transform spectral data for the current frame using prediction coding data; and an prediction coding weighting data calculator for calculating the prediction coding data by combining a weighted sum of prediction coding data derived from a past frame and prediction coding data derived from the current frame to acquire interpolated prediction coding data.

20. The audio decoder in accordance with claim 19, wherein the prediction coding weighting data calculator is configured to convert the prediction coding data into a spectral representation comprising a weighting value for each frequency band, and wherein the spectral weighter is configured to weight all spectral values in a band by the same weighting value for this band.

21. The audio decoder of claim 16, wherein the synthesis window is configured to comprise a total time length less than 50 ms and greater than 25 ms, wherein the first and the third overlap portions comprise the same length and wherein the third overlap portion comprises a length smaller than 15 ms.

22. The audio decoder of claim 16, wherein the synthesis window comprises a length of 30 ms without zero padded portions, the first and third overlap portions each comprise a length of 10 ms and the non-overlapping portion comprises a length of 10 ms.

23. The audio decoder of claim 16, wherein the transform parameter decoder is configured to apply, for the spectral-time transform, a DCT transform comprising a number of samples corresponding to a frame length, and a defolding operation for generating a number of time values being twice the number of time values before the DCT, and to apply the synthesis window to a result of the defolding operation, wherein the synthesis window comprises, before the first overlap portion and subsequent to the third overlap portion zero portions comprising a length being half the length of the first and third overlap portions.

24. A method of decoding an encoded audio signal, comprising:

performing a decoding of data for a prediction coded frame from the encoded audio signal;

performing a decoding of data for a transform coded frame from the encoded audio signal, wherein performing a decoding of data for a transform coded frame comprises performing a spectral-time transform and applying a synthesis window to transformed data to acquire data for the current frame and a future frame, the synthesis window comprising a first overlap portion, an adjacent second non-overlapping portion and an adjacent third overlap portion, the third overlap portion being associated with audio samples for the future frame and the non-overlap portion being associated with data of the current frame; and overlapping and adding synthesis windowed samples associated with the third overlap portion of a synthesis window for the current frame and synthesis windowed samples associated with the first overlap portion of a synthesis window for the future frame to acquire a first portion of audio samples for the future frame, wherein a rest of the audio samples for the future frame are synthesis windowed samples associated with the second non-overlapping portion of the synthesis window for the future frame acquired without overlap-adding, when the current frame and the future frame comprise transform-coded data.

25. A computer program comprising a program code for performing, when running on a computer, the method of encoding an audio signal of claim 15.

26. A computer program comprising a program code for performing, when running on a computer, the method of decoding an audio signal of claim 24.

* * * * *